US012593926B1

(12) United States Patent
Flannery et al.

(10) Patent No.: US 12,593,926 B1
(45) **Date of Patent: *Apr. 7, 2026**

(54) BOTTOM RAIL CONTROLLED BED RAIL

(71) Applicant: Regalo International, LLC, Burnsville, MN (US)

(72) Inventors: Mark A. Flannery, Longboat Key, FL (US); Kasey L. Pipo, Elko New Market, MN (US)

(73) Assignee: Regalo International, LLC, Burnsville, MN (US)

( * ) Notice: Subject to any disclaimer, the term of this patent is extended or adjusted under 35 U.S.C. 154(b) by 994 days.

This patent is subject to a terminal disclaimer.

(21) Appl. No.: 17/695,806

(22) Filed: Mar. 15, 2022

Related U.S. Application Data

(63) Continuation of application No. 16/573,491, filed on Sep. 17, 2019, now Pat. No. 11,278,126.

(60) Provisional application No. 62/746,412, filed on Oct. 16, 2018, provisional application No. 62/732,461, filed on Sep. 17, 2018.

(51) Int. Cl.
*A47C 21/08* (2006.01)
*A47D 15/00* (2006.01)

(52) U.S. Cl.
CPC ..... *A47C 21/08* (2013.01); *A47D 15/008* (2013.01)

(58) Field of Classification Search
CPC ..... A47D 7/02; A47C 21/08; A61G 7/0507; A61G 7/0508; A61G 7/0509; A61G 7/0518; A61G 7/0519
USPC ..... 5/426
See application file for complete search history.

(56) References Cited

U.S. PATENT DOCUMENTS

| | | | | |
|---|---|---|---|---|
| 4,833,743 | A | 5/1989 | Howell | |
| 5,596,776 | A * | 1/1997 | Huang | A47C 21/08 5/426 |
| 5,761,756 | A | 6/1998 | Nowak | |
| 6,374,437 | B1 | 4/2002 | Voelker | |
| 6,990,697 | B1 | 1/2006 | Clute | |
| 7,624,459 | B2 | 12/2009 | Nygren | |
| 7,908,689 | B2 * | 3/2011 | Flannery | A61G 7/0507 5/426 |
| 8,458,831 | B2 * | 6/2013 | Flannery | A47D 7/02 5/426 |
| 9,387,141 | B1 | 7/2016 | Flannery | |
| 11,278,126 | B1 * | 3/2022 | Flannery | A47C 21/08 |
| 2003/0024047 | A1 * | 2/2003 | Wu | A47C 21/08 5/430 |
| 2004/0168251 | A1 * | 9/2004 | Waldman | A47C 21/08 5/426 |
| 2004/0187209 | A1 | 9/2004 | Flannery | |
| 2004/0250347 | A1 | 12/2004 | Brewin | |
| 2006/0174408 | A1 * | 8/2006 | Flannery | A61G 7/0507 5/426 |

* cited by examiner

*Primary Examiner* — David R Hare

(57) ABSTRACT

The present bottom rail controlled bed rail is a one handed bed rail where the bottom rail is lifted out of seats in left and right bases, whereupon the guard rail portion of the bed rail is free to swing relative to the left and right bases. When the bottom rail is lifted, the bottom rail slides up right and left end frame members of the guard rail portion. The left and right end frame members remain pivotally engaged to the left and right bases.

12 Claims, 35 Drawing Sheets

BOTTOM RAIL CONTROLLED BED RAIL

This application is a continuation of U.S. patent application Ser. No. 16/573,491 filed Sep. 17, 2019 (U.S. Pat. No. 11,278,126 issued Mar. 22, 2022) and claims the benefit thereof under 35 U.S.C. § 120, which application claims the benefit under 35 U.S.C. 119(e) of U.S. Provisional Patent Application No. 62/746,412 filed Oct. 16, 2018 and U.S. Provisional Patent Application No. 62/732,461 filed Sep. 17, 2018, all of which applications are hereby incorporated by reference in their entireties into this application.

FIELD OF THE INVENTION

The present invention generally relates to a bed rail and particularly relates to a bed rail having a guard rail frame portion that can be unlocked, swung down, swung up, and then re-locked, with all steps performed by one hand.

BACKGROUND OF THE INVENTION

A bed rail conventionally has two independently controlled pivot locations such that a caregiver has to first attend to one pivot location and then subsequently attend to the second pivot location. In the meantime, prior to the caregiver getting to the second pivot location, a portion of the bed rail may start to swing down by itself and bother the caregiver or hinder the caregiver's ability to unlock the second pivot location. To swing the bed rail back up for the night may be even more difficult because it may be necessary to manipulate one pivot location with one hand while holding up the distant to-be-locked end of the bed rail with the other hand. Each of the swing down and swing back up operations is a two handed operation and, with some conventional bed rails, is a two person operation.

SUMMARY OF THE INVENTION

A feature of the present invention is the provision in a bottom rail controlled bed rail, of a bottom rail controlling the engagement and disengagement of the swinging of the guard rail portion of the bed rail from an up position to a down position.

Another feature of the present invention is the provision in a bottom rail controlled bed rail, of a left side base and a right side base, where the left side base includes a left seat, and where the right side base includes a right seat.

Another feature of the present invention is the provision in a bottom rail controlled bed rail, of a frame that includes a first frame portion and a second frame portion, where the first frame portion is a guard rail frame portion that confronts a side of a mattress and where the second frame portion is a leg frame portion that is tucked between the mattress and a mattress support.

Another feature of the present invention is the provision in a bottom rail controlled bed rail, of the first frame portion including a left end frame member, a right end frame member, an upper frame member, and a lower frame member, the upper frame member extending between the left and right end frame members, the lower frame member extending between the left and right end frame members.

Another feature of the present invention is the provision in a bottom rail controlled bed rail, of the first frame portion being pivotally engaged to the left base at a left pivot location and the first frame portion being pivotally engaged to the right base at a right pivot location such that the first frame portion is swingable between up and down positions.

Another feature of the present invention is the provision in a bottom rail controlled bed rail, of the second frame portion including a left leg and a right leg, the left leg engaged to the left base, the right leg engaged to the right base.

Another feature of the present invention is the provision in a bottom rail controlled bed rail, of the lower frame member being seatable in the left seat of the left base, of the lower frame member being seatable in the right seat of the right base, of the first frame portion being fixed relative to the second frame portion when the lower frame member is seated in the left and right seats, and of the first frame portion being swingable when the first frame portion is out of the left and right seats.

Another feature of the present invention is the provision in a bottom rail controlled bed rail, of the lower frame member being slideably engaged on each of the left and right end frame members such that the lower frame member is slideable out of the left and right seats whereupon the first frame portion is swingable.

Another feature of the present invention is the provision in a bottom rail controlled bed rail, of the lower frame member being spring biased toward a seated position in the left and right seats of the left and right bases, respectively, where the first frame portion is fixed relative to the second frame portion.

Another feature of the present invention is the provision in a bottom rail controlled bed rail, of the lower frame member including a left end cylindrical portion that slides axially on the left end frame member, and of the lower frame member including a right end cylindrical portion that slides axially on the right end frame member.

Another feature of the present invention is the provision in a bottom rail controlled bed rail, of the left pivot location on the left base being spaced from the left seat in the left base and of the right pivot location on the right base being spaced from the right seat in the right base.

Another feature of the present invention is the provision in a bottom rail controlled bed rail, of the left end frame member being pivotally engaged to the left base and of the right end frame member being pivotally engaged to the right base.

Another feature of the present invention is the provision in a bottom rail controlled bed rail, of a handle engaged to the lower frame member such that a user may readily grasp the handle to thereby lift the lower frame member out of the left and right seats with one hand.

Another feature of the present invention is the provision in a bottom rail controlled bed rail, of the lower frame member including left and right ends, and of a handle engaged to the lower frame member intermediate of the left and right ends of the lower frame member such that a user may readily grasp the handle to thereby lift the lower frame member out of the left and right seats with one hand.

Another feature of the present invention is the provision in a bottom rail controlled bed rail, of a left lower tube portion, a right lower tube portion, and a handle intermediate outer ends of the left and right lower tube portions, of a left cylindrical portion that slides axially on the left end frame member and a right cylindrical portion that slides axially on the right end frame member, of a left tubular receptor extending inwardly from the left cylindrical portion for engagement of the left lower tube portion and a right tubular receptor extending inwardly from the right cylindrical portion for engagement of the right lower tube portion, and of a left arm extending from the left cylindrical portion for engaging the left seat of the left base and a right arm extending from the right cylindrical portion for engaging the right seat of the right base.

Another feature of the present invention is the provision in a bottom rail controlled bed rail, of the lower frame member being a horizontally extending frame member, and of the lower frame member being a bottommost horizontally extending frame member of the first frame portion.

Another feature of the present invention is the provision in a bottom rail controlled bed rail, of a) a left side base and a right side base, of a frame that includes a first frame portion and a second frame portion, of the first frame portion including a left end frame member, a right end frame member, an upper frame member, and a lower frame member, the upper frame member extending between the left end frame member and the right end frame member, the lower frame member extending between the left end frame member and the right end frame member, of the first frame portion being pivotally engaged to the left base at a first location, the lower frame member being releasably engaged to the left base at a second location, the first and second locations being spaced from each other, of the first frame portion being pivotally engaged to the right base at a third location, the lower frame member being releasably engaged to the right base at a fourth location, the third and fourth locations being spaced from each other, of the second frame portion including a left leg and a right leg, the left leg engaged to the left base, the right leg engaged to the right base, of the first location on the left base and the third location on the right base permitting the first frame portion to be swingable between up and down positions, of the second location on the left base and the fourth location on the right base permitting the first frame portion to be fixed relative to the second frame portion when the lower frame member is engaged at the second and fourth locations, of the second location on the left base and the fourth location on the right base permitting the first frame portion to be swingable relative to the second frame portion when the lower frame member is disengaged from the second and fourth locations, and of the lower frame member being slideably engaged on each of the left end frame member and right end frame member such that the lower frame member may be slid on the left frame member and the right end frame member away from the second and fourth locations such that the first frame portion may swing relative to the second frame portion.

Another feature of the present invention is the provision in a bottom rail controlled bed rail, of the second location including a left seat in the left base, and of the fourth location including a right seat in the right base.

Another feature of the present invention is the provision in a bottom rail controlled bed rail, of the right seat including a U-shape and of the left seat including a U-shape.

Another feature of the present invention is the provision in a bottom rail controlled bed rail, of a left side base and a right side base, the left side base having a left seat, the right side base having a right seat, of a frame that includes a leg frame portion and a guard rail frame portion, the leg frame portion being disposed between the mattress and mattress support, the guard rail portion extending at a side and beyond a top of the mattress, of the guard rail frame portion including a lower frame member, the lower frame member being seatable in the left and right seats of the left and right bases, of the guard rail frame portion being pivotally engaged to the left and right bases at a left and right pivot locations, respectively, of the leg frame portion including a left leg and a right leg, the left leg engaged to the left base, the right leg engaged to the right base, of the guard rail frame portion being fixed relative to the leg frame portion when the lower frame member is seated in the left and right seats, the guard rail frame portion being swingable when the lower frame member is out of the left and right seats, and of the lower frame member being slideably engaged on the guard rail portion such that the lower frame member is slideable out of the left and right seats whereupon the rail frame portion is swingable.

An advantage of the present invention is that the guard rail frame portion of the bed rail can be unlocked, swung down, swung up, and re-locked, with all such steps being performed by one hand.

Another advantage of the present invention is that the guard rail frame portion of the bed rail can be unlocked, swung down, swung up, and re-locked, with all such steps being performed by one hand at one location on the guard rail frame portion.

Another advantage of the present invention is that the unlocking step is performed by a lift operation where only a portion of the guard rail frame portion is lifted so as to minimize the weight involved for such a lifting step.

Another advantage of the present invention is that separate connections spaced apart by a relatively great distance are unlocked at the same time by the same motion holding one cross member.

Another advantage of the present invention is that the bed rail is inexpensive to manufacture.

Another advantage of the present invention is that the bed rail includes a minimum of parts.

Another advantage of the present invention is that the steps of unlocking the left and right seats by lifting, swinging down the guard rail frame portion to a down position, swinging up the guard rail frame portion to an up position, and re-locking the guard rail frame portion into the right and left seats are simple and easy.

DESCRIPTION

Figure 1:
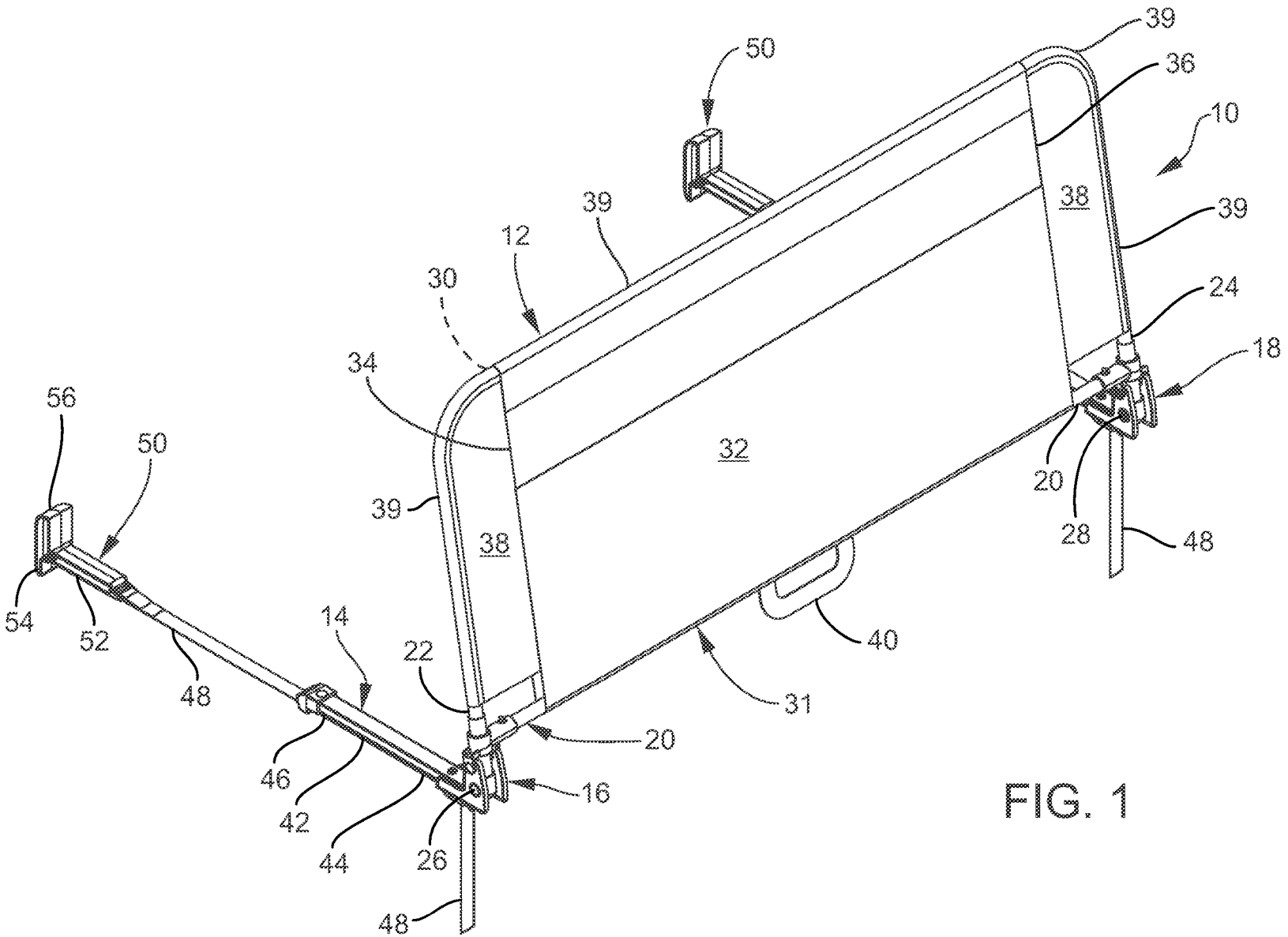
FIG. 1 is a perspective view of the present bottom rail controlled bed rail showing the bottom rail controlled bed rail in an operating position where the bottom rail assembly is engaged to the bottom rail receptors.

As shown in FIG. 1, the present bottom rail controlled bed rail is indicated by the reference numeral 10. Bed rail 10 includes a first frame portion 12 or guard rail frame portion 12, a second frame portion 14 or a leg frame portion 14, a left base 16, and a right base 18. Guard rail frame portion 12 is engaged to the leg frame portion 14 through the left and right bases 16, 18. The guard rail frame portion 12 includes a lower frame member 20 that is slideable up left and right end frame members 22, 24 of the guard rail frame portion 12. As the lower frame member 20 is slideable up the left and right frame members 22, 24, the lower frame member 20 disengages itself from the left and right bases 16, 18, thereby permitting the guard rail frame portion 12 as a whole to swing down relative to the left and right bases 16, 18 and relative to the leg frame portion 14. As the guard rail frame portion 12 swings down, the guard rail frame portion 12 remains pivotally engaged to the left and right bases 16, 18 through left and right pivot connections 26, 28 between the lower ends of the left and right end frame members 22, 24 and the left and right bases 16, 18.

Guard rail frame portion 12 includes the lower frame member 20, the left end frame member 22, the right end frame member 24, and an upper frame member 30. Members 20, 22, 24 and 30 are tubular and formed of metal. Guard rail frame portion 12 forms generally the shape of a rectangle where adjacent sides are of unequal length. Left end frame member 22, upper frame member 30, and right end frame member 24 form the shape of an inverted U.

Guard rail frame portion 12 is relatively rigid when the lower frame member 20 is seated in the left and right bases 16, 18. Rail portion 12 remains relatively rigid when lower frame member 20 slides upwardly and downwardly on the left and right end frame members 22, 24. Lower frame member 20 is spring biased toward the lower ends or distal ends or pivoting ends of the left and right end frame members 22, 24. Lower frame member 20 slides a minimal amount on the left and right end frame members 22, 24 such that lower frame member 20 remains positioned on lower end portions or distal end portions or pivoting end portions of the left and right end frame members 22, 24 whether the lower frame member 20 is seated or not seated in the left and right bases 16, 18. The further away that the lower frame member 20 is from a seated position in the left and right bases 16, 18, the greater the spring biased force is that seeks to return the lower frame member 20 toward the absolute lower ends or absolute distal ends or the absolute pivoting ends of the left and right end frame members 22, 24.

FIG. 1 shows sheeting 31 engaged to the guard rail frame portion 12. Sheeting 31 includes a first sheeting portion 32 formed in the shape of a loop and engaged between the lower frame portion 20 and the upper frame portion 30. First sheeting portion 32 includes left edge portions 34 that are spaced from left end frame member 22. First sheeting portion 32 includes right edge portions 36 that are spaced from right end frame member 24. First sheeting portion 32 engages straight portions of the lower and upper frame members 20, 30. First sheeting portion 32 includes a front panel of sheeting and a rear panel of sheeting.

Sheeting 31 includes second sheeting portions 38. Each of the second sheeting portions 38 is a half-loop. One of the second sheeting portions 38 loops about left end frame member 22 and a portion of the upper frame member 30. The other of the second sheeting portions 38 loops about the right end frame member 24 and a portion of the upper frame member 30. Each of the sheeting portions 38 includes two inner vertical edges, one of which is engaged to the front panel of first sheeting portion 32 and one of which is engaged to the rear panel of first sheeting portion 32.

Sheeting 31 includes an inverted U-shaped sleeve 39 through which is slipped left end frame member 22, upper frame member 30, and right end frame member 24. Sheeting portion 32 includes a portion of U-shaped sleeve 39. Each of the sheeting portions 38 includes a portion of U-shaped sleeve 39. Sleeve 39 is tubular with a left open end adjacent to the left outer end of the lower frame member 20 and with a right open end adjacent to the right outer end of the lower frame member 20.

Sheeting portions 32, 38 may be engaged, such as by stitching, to each other.

Guard rail frame portion 12 includes a handle 40. Handle 40 is one mechanism by which the lower frame member 20 can be lifted up and unseated from the left and right bases 16, 18. Handle 40 may be directly engaged to lower frame member 20 through a pair of openings formed in sheeting portion 32. Handle 40 may be directly engaged to sheeting portion 32 which in turn is directly engaged to lower frame member 20. Handle 40 may be integral and one-piece with the sheeting portion 32. Handle 40 may be integral and one-piece with the lower frame member 20. Handle 40 is formed in the shape of an inverted U. Handle 40 is positioned intermediate left and right outer end portions of the lower frame member 20. A center of the handle 40 is vertically aligned with a center of the lower frame member 20 such that, when the user lifts up on the handle 40, the left and right end portions of the lower frame member 20 are unseated at the same time from the left and right bases 16, 18. Handle 40 is preferably formed of a flexible fabric material such that handle 40 can flex forwardly, rearwardly, and from side to side. If desired, handle 40 may be tubular and formed of metal.

FIG. 1 further shows leg frame portion 14. Leg frame portion 14 includes a pair of tubular legs 42 that are rigidly engaged to the left and right bases 16, 18. Each of the tubular legs 42 includes a proximal end portion 44 and a distal end portion 46. Extending from underneath the distal end portion 46 is a flexible strap 48 that in turn is engaged to a counter member 50. Counter member 50 is a three portion rigid piece having a planar body 52, a downward extension 54 confronting the far side of the mattress support or box spring, and an upward extension 56 for confronting the far side of the mattress. Planar body 52 is sandwiched between the mattress and the mattress support. Strap 48 travels underneath the tubular leg 42 from the distal end portion 46 to the proximal end portion 44 where strap 48 is engaged by a catch mechanism 49 such that the length of strap 48 can be adjusted. For example, the effective length of strap 48 can be reduced to draw the counter member extensions 54, 56 tightly against the sides of the mattress support and mattress, whereupon the strap 48 can be fixed by the catch mechanism 49 to maintain the tightness between the upward extensions of the left and right bases 16, 18 and the counter member extensions 54, 56. One or more of a) the rear faces of the upward extensions of the left and right bases 16, 18 and b) the left and right end frame members 22, 24 act as counter members on the near side of the mattress.

Figure 2B:
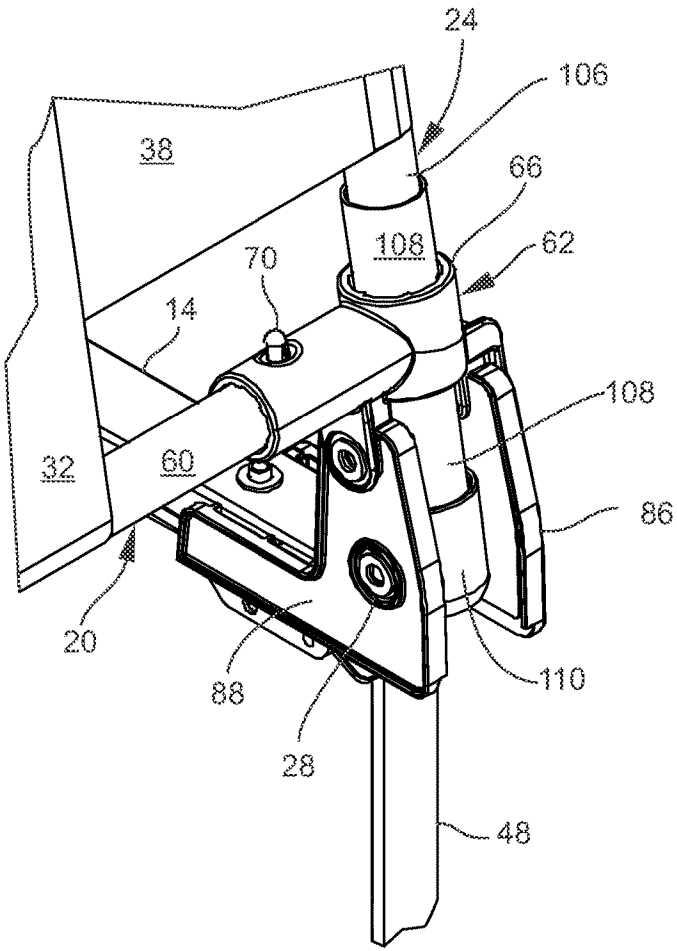
FIG. 2B shows a detail perspective view of the right end portion of the bottom rail assembly of FIG. 1 engaged to the right bottom rail receptor of FIG. 1.
Figure 2A:
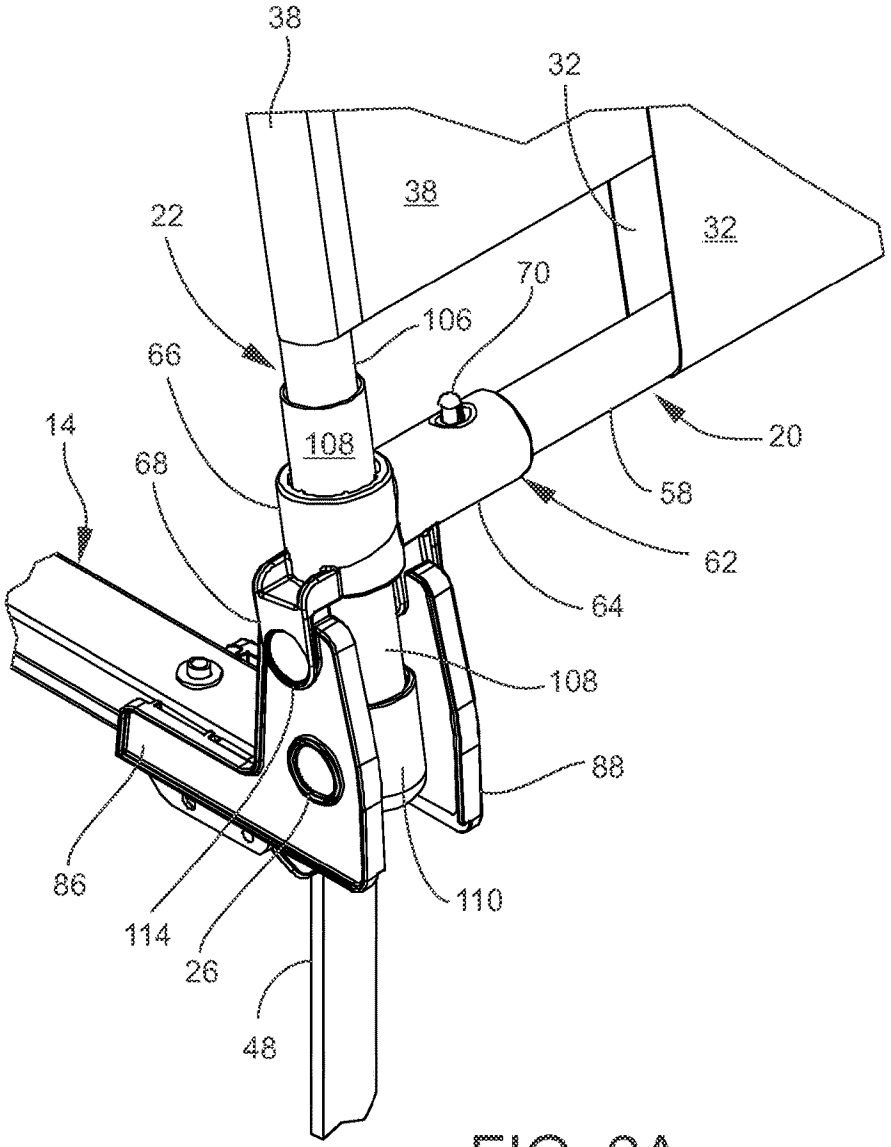
FIG. 2A shows a detail perspective view of the left end portion of the bottom rail assembly of FIG. 1 engaged to the left bottom rail receptor of FIG. 1.
Figure 13:
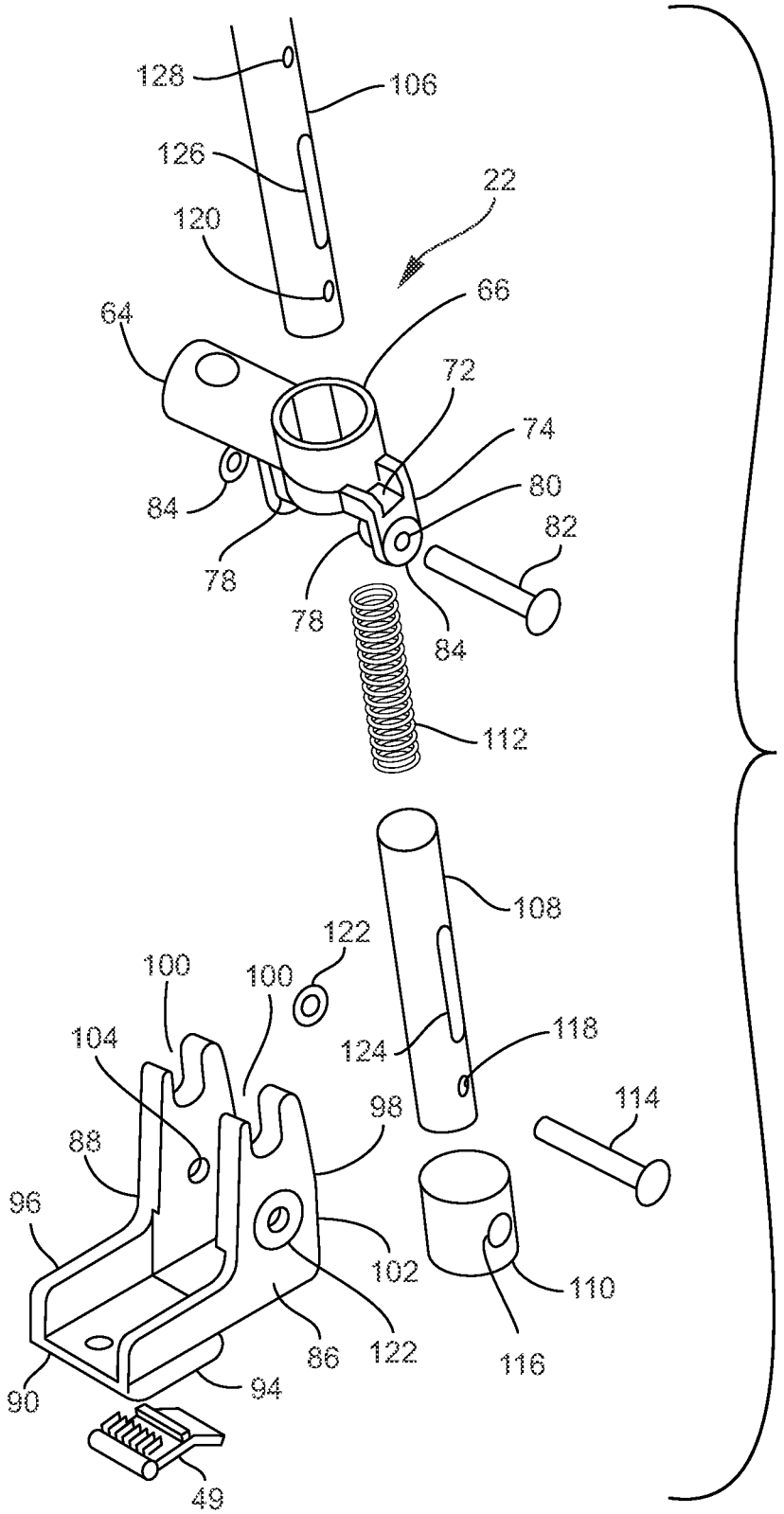
FIG. 13 is a perspective exploded detail view of a portion of the left end of the bottom rail controlled bed rail of FIG. 12.

FIG. 2A and FIG. 2B show enlarged views of the left and right bases 16, 18, respectively, and the lower frame member 20 extending therebetween. Lower frame member 20 includes a left tube 58, a right tube 60, and a seating and sliding assembly 62. The seating and sliding assembly 62 makes up the outer ends of the left and right tubes 58, 60. The seating and sliding assembly 62 includes a tube receptor 64, a cylinder 66, and a pair of arms 68. Tube receptor 64 is rigidly engaged to cylinder 66 and extends inwardly from cylinder 66 to engage the outer end of its respective left or right tube 58, 60. Tube receptor 64 is tubular and is a female receptor for the male outer end of left or right tube 58, 60. A spring biased button 70, housed in the outer end of each of the left and right tubes 58, 60, releasably engages the tube receptor 64 to its respective left or right tube 58, 60. A pair of arms 68 is rigidly engaged to a lower portion of the cylinder 66. Each of the arms 68 is formed in the nature of an angle iron such that each of the arms 68 extends outwardly and then downwardly. Each of the arms 68 includes an outward extension 72 and a downward extension 74, shown in FIG. 10. The outward extension 72 is engaged to the cylinder 66. The downward extension 74 extends downwardly from the distal end of outward extension 72. Front and rear braces 76 are engaged between the outward extension 72 and the cylinder 66. As shown in FIG. 13, seating and sliding assembly 62 further includes a seat engaging piece 78 disposed immediately inwardly of each of the downward extensions 74. Seat engaging piece 78 is rigidly engaged to the outward extension 72 and is rigidly engaged to the downward extension 74. Each of the seat engaging piece 78 and downward extension 74 includes an inverted U-shape. Downward extension 74 extends further downwardly than does seat engaging piece 78. Each of the seat engaging piece 78 and downward extension 74 extends in the axial direction of cylinder 66. Each of the seat engaging piece 78 and downward extension 74 includes a through opening 80 for a double headed rivet pin connector 82. A washer 84 may be disposed between each of the heads of the pin 82 and an outside face of the downward extension 74 on both arms 68.

As shown in FIG. 13, each of the left and right bases 16, 18 includes an outer plate 86 and an inner plate 88. The plates 86, 88 define parallel vertical planes. Plates 86 and 88 are engaged to each other by a rear plate 90 defining a horizontal plane. The toothed catch mechanism 49 is pivotally affixed between a pair of side ridges 94 extending downwardly from the rear plate 90. Strap 48 is engaged to and travels underneath leg frame portion 14 and is engaged by toothed catch mechanism 49 to hold the bed rail 10 between the counter members 50 and one or more of a) the bases 16, 18, and b) the left and right end frame members 22, 24. Each of the plates 86, 88 is L-shaped such that each of the plates 86, 88 has a rearward extension portion 96 and an upward extension portion 98. Rear plate 90 is engaged between the rearward extension portions 96. U-shaped seats 100 are formed in the top of the upward extension portion 98. Each of the U-shaped seats 100 includes two straight edge portions. The two straight edge portions do not define absolute vertical straight lines. Instead the two straight edge portions are oblique relative to an absolute vertical straight line such that the guard rail frame portion 12 is oblique relative to the side of a mattress instead of parallel to the side of the mattress. Each of the upward extensions 98 includes a front edge 102 and a bottom edge 103. Each of the upward extensions 98 includes a pivot through opening 104 for its respective left or right pivot connection 26, 28 to the respective left or right end frame member 22, 24.

Each of the left and right end frame members 22, 24 includes a main tube 106, a base tube 108, a lower end cap 110, and a coil spring 112. The left end frame member 22 is shown in FIG. 13.

Lower end cap 110 includes a pair of aligned pin holes 116. A lower portion of base tube 108 includes a pair of aligned pin holes 118. A lower portion of main tube 106 includes a pair of aligned pin holes 120. Pin holes 116, 118, 120, and pin holes 104 of plates 86, 88 are all aligned with each other and receive pin 114 so as to make up the pivot connection 26 or 28. Washers 122 can be disposed immediately inwardly of the double headed rivet pin connector 114. Guard rail frame portion 12 pivots or swings relative to leg frame portion 14 by the pivot connections 26, 28.

Base tube 108 frictionally fits into lower end cap 110 and is fixed therein by pin connector 114. Main tube 106 frictionally fits inside of base tube 108 and is fixed therein by pin connector 114. Base tube 108 includes a pair of axially extending and diametrically opposed slots 124. Main tube 106 includes a pair of axially extending and diametrically opposed slots 126. When main tube 106 is fixed in base tube 108, slots 124 align with slots 126. Cylinder 66 is slid over base tube 108 and is slidingly engaged thereon by pin connector 82 extending through pin openings 80 and slots 124, 126. The inside diameter of cylinder 66 is slightly greater than the outside diameter of base tube 108 such that cylinder 66 can slide on base tube 108. Coil spring 112 is disposed inside of main tube 106 between a cross pin 128 set in main tube 106 and the pin connector 82 that traverses the axial opening of the cylinder 66. Coil spring 112 is disposed therein in a compressed state such that coil spring 112 continually urges the seating and sliding assembly 62 and lower frame member 20 in a direction toward the lower end cap 110 and toward a seated position where the seat engaging pieces 78 are seated in the U-shaped seats 100, where the downward extensions 74 confront the outside faces of plates 86, 88 to minimize side-to-side movement of the seating and sliding assembly 62 relative to its respective base 16 or 18, and where the shaft of the pin connector 82 is in a lower portion of the slots 124, 126. When a user lifts the lower frame member 20, the seating and sliding assembly 62 is lifted as well since the assembly 62 is part of the lower frame member 20. Such lifting continues until the pin connector 82 hits the upper portion of slots 124, 126 or until the seat engaging pieces 78 clear the tops of the left and right bases 16, 18, whereupon the guard rail frame portion 12 is pivoted or swung forwardly, whereupon the seat engaging pieces 78 ride upon the front edges 102 of plates 86, 88.

In FIGS. 1, 2A, and 2B, the seat engaging pieces 78 are in the U-shaped slots 100 of the left and right bases 16, 18.

Figure 3:
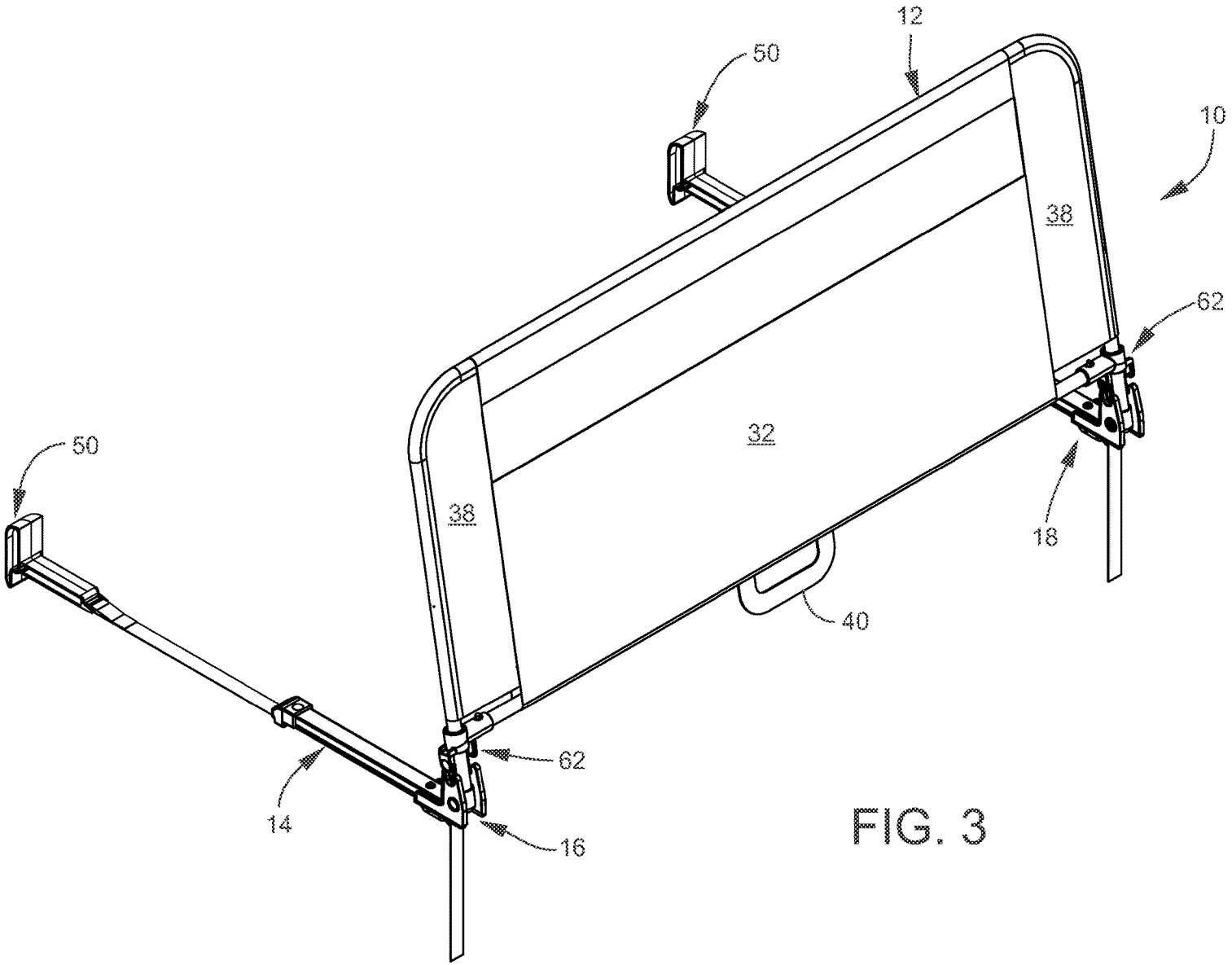
FIG. 3 is a perspective view of the bottom rail controlled bed rail of FIG. 1 showing the bottom rail assembly having been slid up the right and left end support members of the bottom rail controlled bed rail and out of engagement with the bottom rail receptors.
Figure 4B:
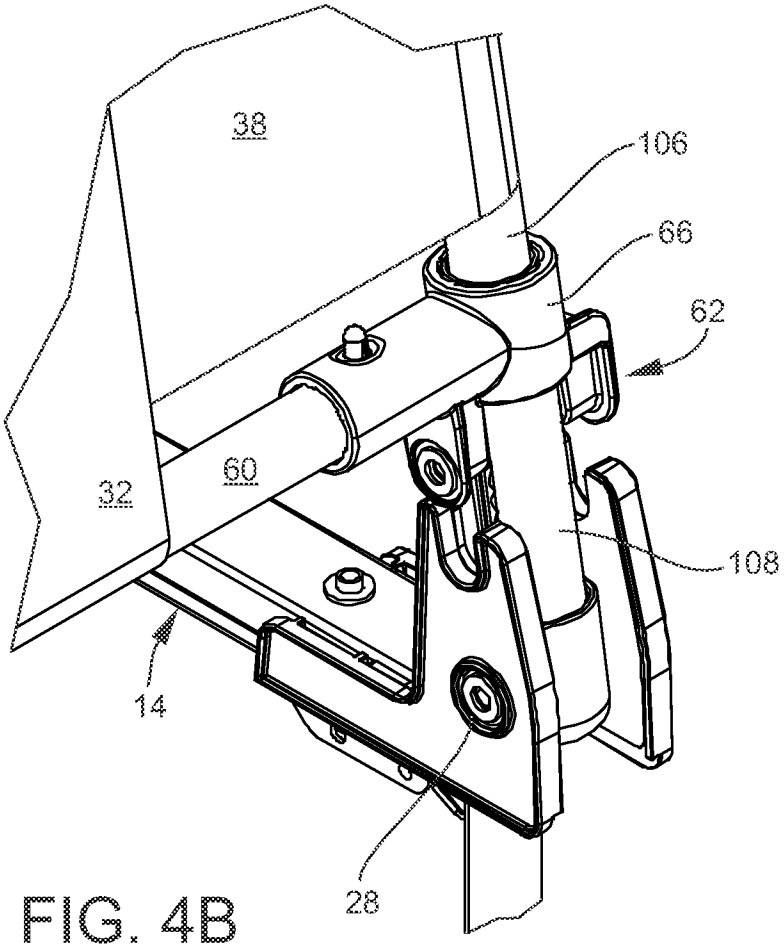
FIG. 4B shows a detail perspective view of the right end portion of the bottom rail assembly of FIG. 3 having been slid up the right end support member of the bottom rail controlled bed rail and out of engagement with the right bottom rail receptor of FIG. 3.
Figure 4A:
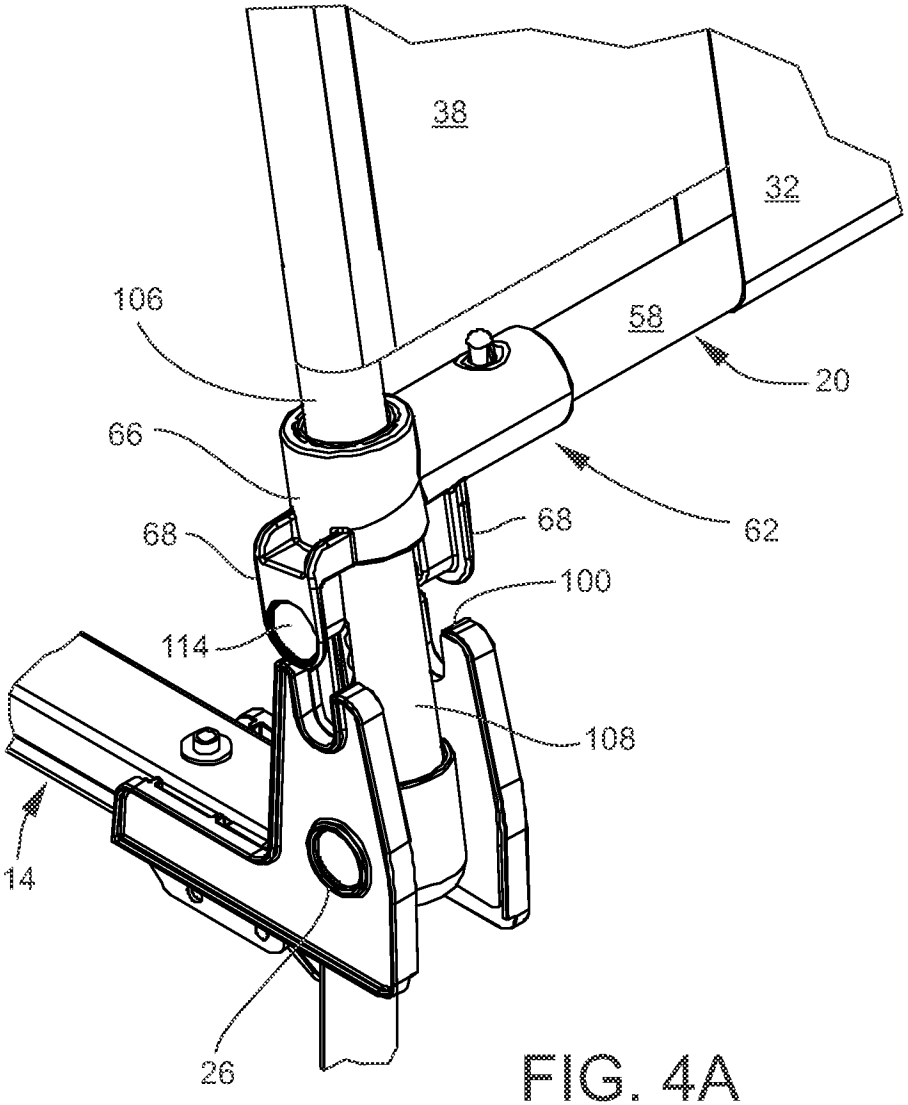
FIG. 4A shows a detail perspective view of the left end portion of the bottom rail assembly of FIG. 3 having been slid up the left end support member of the bottom rail controlled bed rail and out of engagement with the left bottom rail receptor of FIG. 3.

In FIGS. 3, 4A, and 4B, the seat engaging pieces 78 are out of the U-shaped slots 100 because the handle 40 has been operated to lift the lower frame member 20 out of the left and right bases 16, 18. As the handle 40 and lower frame member 20 are lifted, coil springs 112 are compressed by the pin connectors 114 rising in the slots 124, 126. The bottoms of the seat engaging pieces 78 clear the tops of the bases 16, 18 prior to or about the same time as the pin connectors 114 hit the tops of the slots 124, 126. At about the same time as the seat engaging pieces 78 clear the tops of the bases 16, 18 and at about the same time as the pin connectors 114 hit the tops of the slots 124, 126, the tops of the cylinders 66 are about flush with the tops of the base tubes 108 as shown in FIGS. 4A and 4B.

Figure 5:
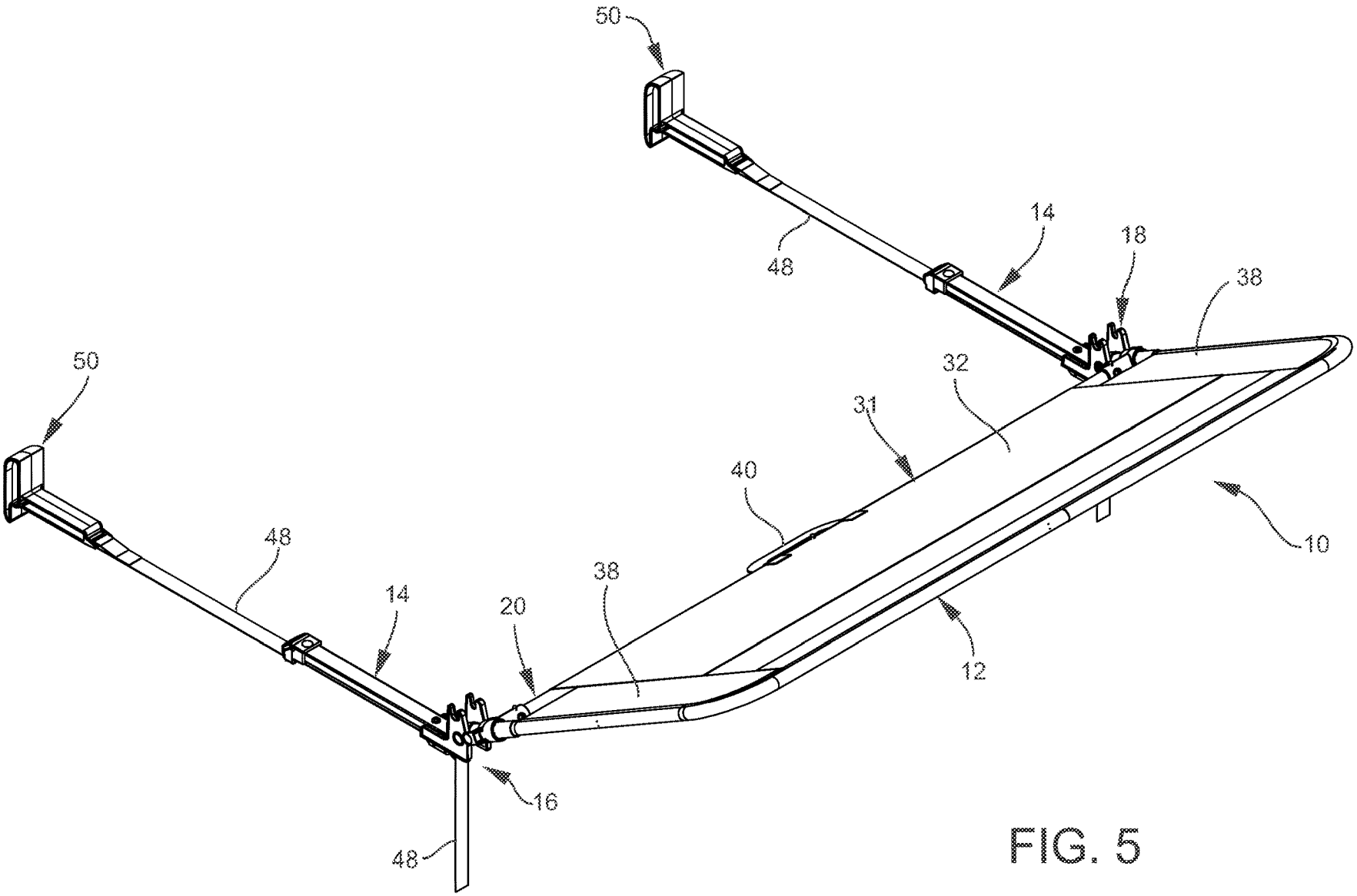
FIG. 5 is a perspective view of the bottom rail controlled bed rail of FIG. 1 showing the bottom rail controlled bed rail having been swung forwardly after the bottom rail assembly has been displaced from the bottom rail receptors.
Figure 6B:
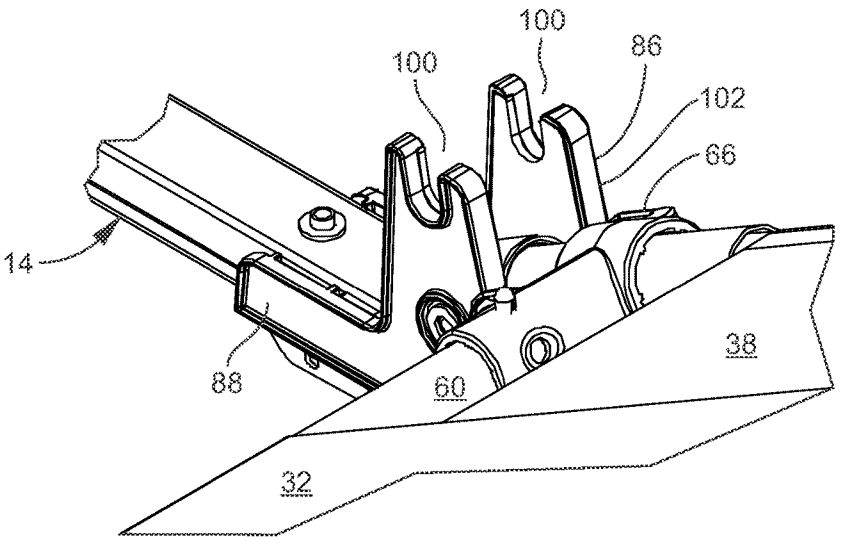
FIG. 6B shows a detail perspective view of the right end portion of the bottom rail assembly of FIG. 5 having been displaced from the right bottom rail receptor of FIG. 5.
Figure 6A:
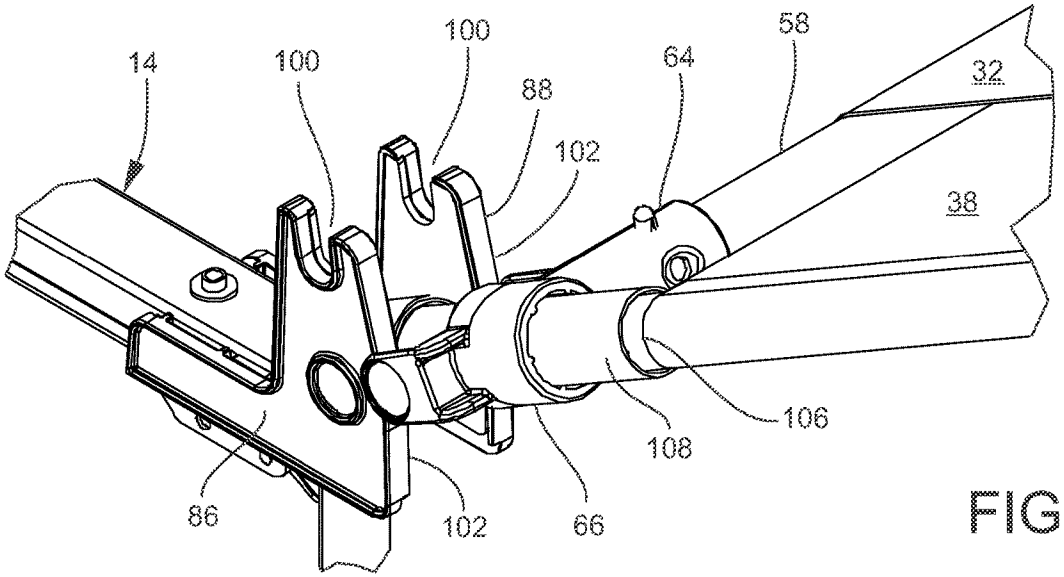
FIG. 6A shows a detail perspective view of the left end portion of the bottom rail assembly of FIG. 5 having been displaced from the left bottom rail receptor of FIG. 5.

In FIGS. 5, 6A, and 6B, the lower frame member 20 is free and clear of the bases 16, 18 such that the guard rail frame portion 12 can be swung away from the sides of the mattress and mattress support. As the handle 40 and lower frame member 20 are released or released from being lifted and the guard rail frame portion 12 is swung away from the sides of the mattress and mattress support, the seat engaging pieces 78 begin to ride on the front edges 102 of the plates 86, 88, the downward extensions 74 begin to ride on the outer side faces of the plates 86, 88 such that the seating and sliding assembly 62 is trapped on its respective base 16 or 18, and the compression or coil springs 112 begin to push the cylinder 66 in the direction toward the lower end cap 110.

Figure 7:
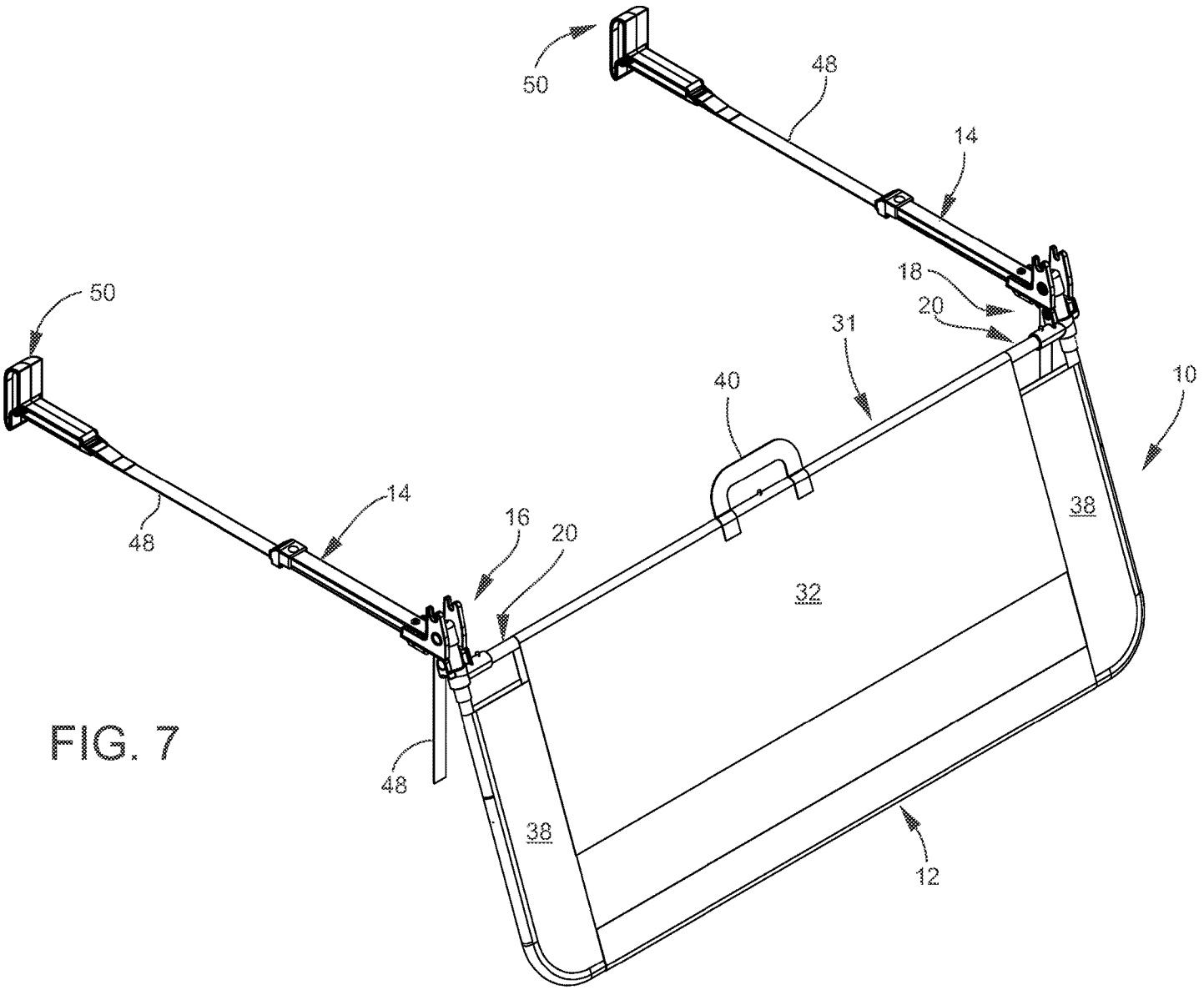
FIG. 7 is a perspective view of the bottom rail controlled bed rail of FIG. 1 showing the bottom rail controlled bed rail having been swung to a down position after the bottom rail assembly has been displaced from the bottom rail receptors.
Figure 8B:
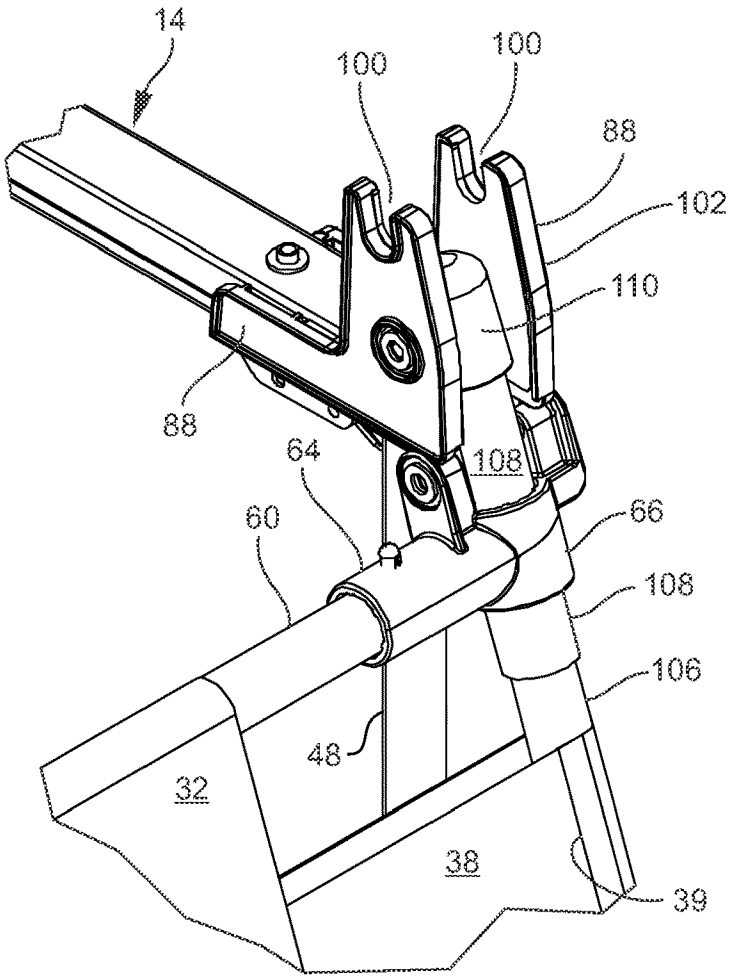
FIG. 8B shows a detail perspective view of the right end portion of the bottom rail assembly of FIG. 7 having been displaced from the right bottom rail receptor of FIG. 7.
Figure 8A:
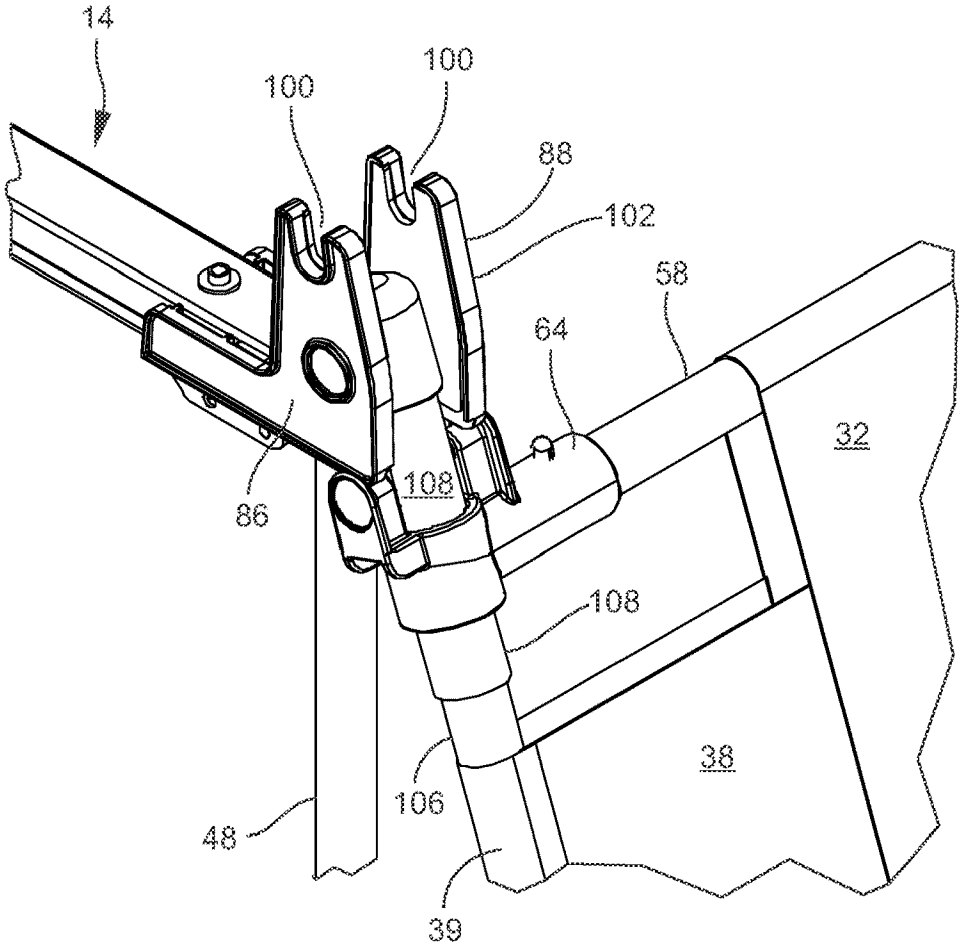
FIG. 8A shows a detail perspective view of the left end portion of the bottom rail assembly of FIG. 7 having been displaced from the left bottom rail receptor of FIG. 7.

In FIGS. 7, 8A, and 8B, the seat engaging pieces 78 continue to ride on the front edges 102 of the plates 86, 88, the downward extensions 74 continue to ride on the outer side faces of the plates 86, 88 such that the seating and sliding assembly 62 is trapped on its respective base 16 or 18, and the compression or coil springs 112 continue to push the cylinder 66 in the direction toward the lower end cap 110. FIG. 7 shows a down or near down position of the guard rail frame portion 12, where the seat engaging pieces 78 are disposed on the bottom edges 103 of the plates 86, 88 and where the downward extensions 74 still ride on the outer side faces of the plates 86, 88. Where the seat engaging pieces 78 are disposed on the bottom edges 103 of plates 86, 88, the coil spring 112 is still urging the seating and sliding assembly 62 in the direction of the lower end cap 110 and thus the seat engaging pieces 78 also ride the junction of the front and bottom edges 102, 103 of the plates 86, 88. Guard rail frame portion 12 may come to rest under the influence of gravity when guard rail frame portion 12 is in a vertical plane.

Figure 9:
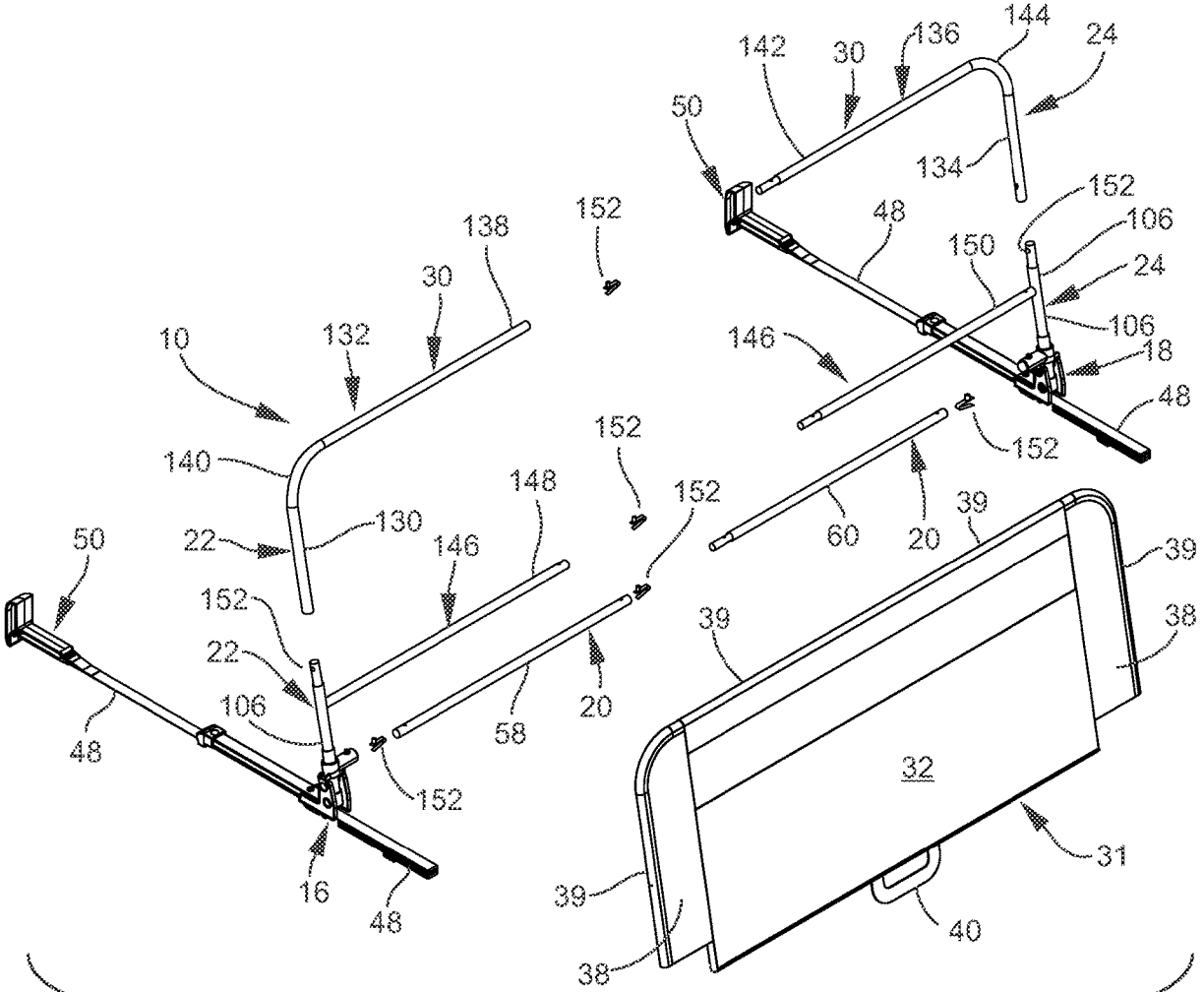
FIG. 9 is a perspective exploded view of the bottom rail controlled bed rail of FIG. 1.

FIG. 9 shows an exploded view of the bed rail 10. Left end frame member 22 includes main tube 106 and a left end tube portion 130 of an L-shaped tube piece 132. Right end frame member 24 includes main tube 106 and a right end tube portion 134 of an L-shaped tube piece 136. L-shaped piece 132 includes an upper tube portion 138 and a curved transition tube portion 140 such that L-shaped piece 132 is made up of tube portion 130, curved transition tube portion 140, and upper tube portion 138. L-shaped piece 136 includes an upper tube portion 142 and a curved transition tube portion 144 such that L-shaped piece 136 is made up of tube portion 134, curved transition tube portion 144, and upper tube portion 142.

Lower frame member 20 is made up of left end tube 58, and right end tube 60, the left seating and sliding assembly 62, and the right seating and sliding assembly 62.

An intermediate horizontally extending frame member 146 is made up of a left intermediate tube 148 and a right intermediate tube 150. Left tube 106 is integral and one piece with intermediate tube 148. Right tube 106 is integral and one piece with intermediate tube 150. Left tube 106 extends at a right angle to tube 148. Right tube 106 extends at a right angle to tube 150.

The upper tube portion 142 of L-shaped piece 136 is a male member that engages the upper tube portion 138 of L-shaped piece 132 that is a female member. A U-shaped button spring 152 releasably engages the male upper tube portion 142 to the female upper tube portion 138. Button spring 152 includes a depressable button that protrudes through aligned openings in male upper tube portion 142 and female upper tube portion 138.

Intermediate tube 150 is a male member that engages the intermediate tube 148 that is a female member. A U-shaped button spring 152 releasably engages the intermediate tubes 148, 150 to each other. Button spring 152 includes a depressable button that protrudes through aligned openings in intermediate tubes 148, 150.

Right lower tube 60 is a male member that engages the left lower tube 58 that is a female member. A U-shaped button spring 152 releasably engages the lower tubes 58, 60 to each other. Button spring 152 includes a depressable button that protrudes through aligned openings in lower tubes 58, 60.

A button spring 152 is also disposed in the connection between the male outer end of lower tube 58 and the female tube receptor 64 of the left seating and sliding assembly 62.

A button spring 152 is also disposed in the connection between the male outer end of right tube 60 and the female tube receptor 64 of the right seating and sliding assembly 62.

The upper end of left main tube 106 is male and the lower end of tube portion 130 is female. This connection includes a button spring 152.

The upper end of right main tube 106 is male and the lower end of tube portion 134 is female. This connection includes a button spring 152.

Figure 10:
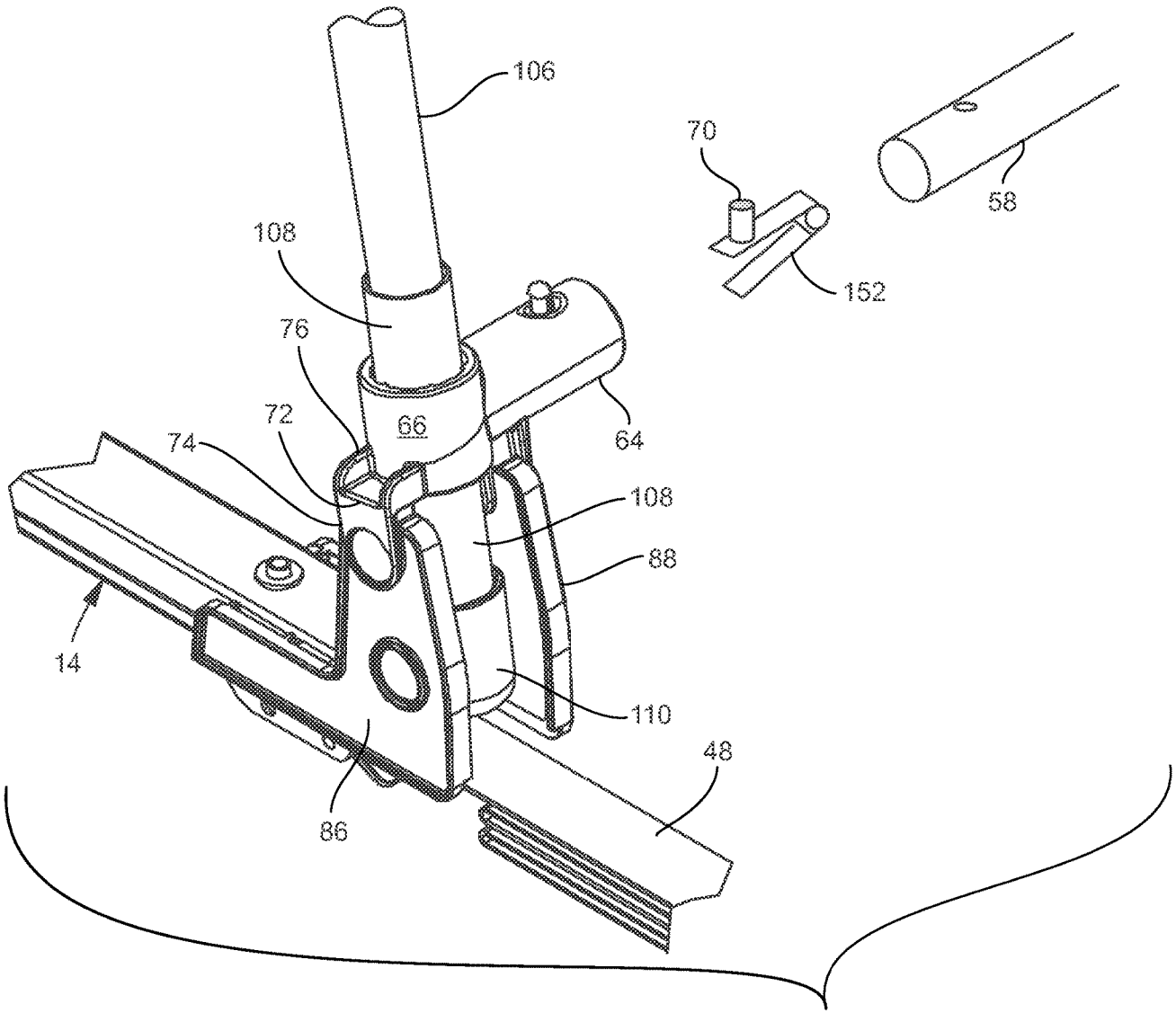
FIG. 10 is a detail perspective view of the left end portion of the bottom rail assembly of FIG. 9 and left bottom rail receptor of FIG. 9.
Figure 11:
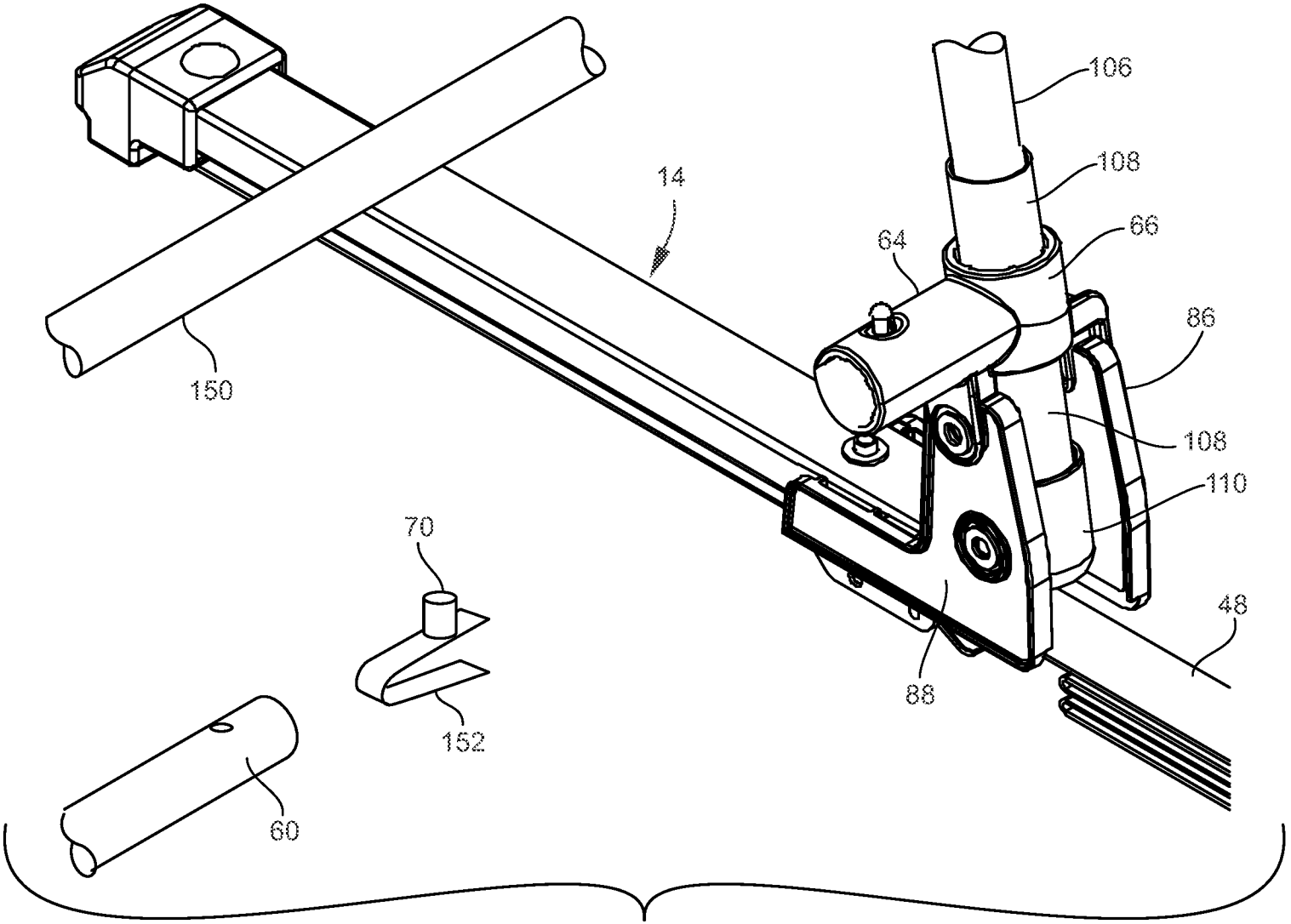
FIG. 11 is a detail perspective view of the right end portion of the bottom rail assembly of FIG. 9 and right bottom rail receptor of FIG. 9.

FIGS. 10 and 11 shows detail exploded perspective views of the left and right lower corner portions of the bed rail 10. Button spring 152 is shown in detail in each of FIGS. 10 and 11. One of the prongs of the spring is a base while the other prong includes button 70 that protrudes through aligned openings in tube 58 and its respective tube receptor 64 and in aligned openings in tube 60 and its respective tube receptor 64.

Figure 12:
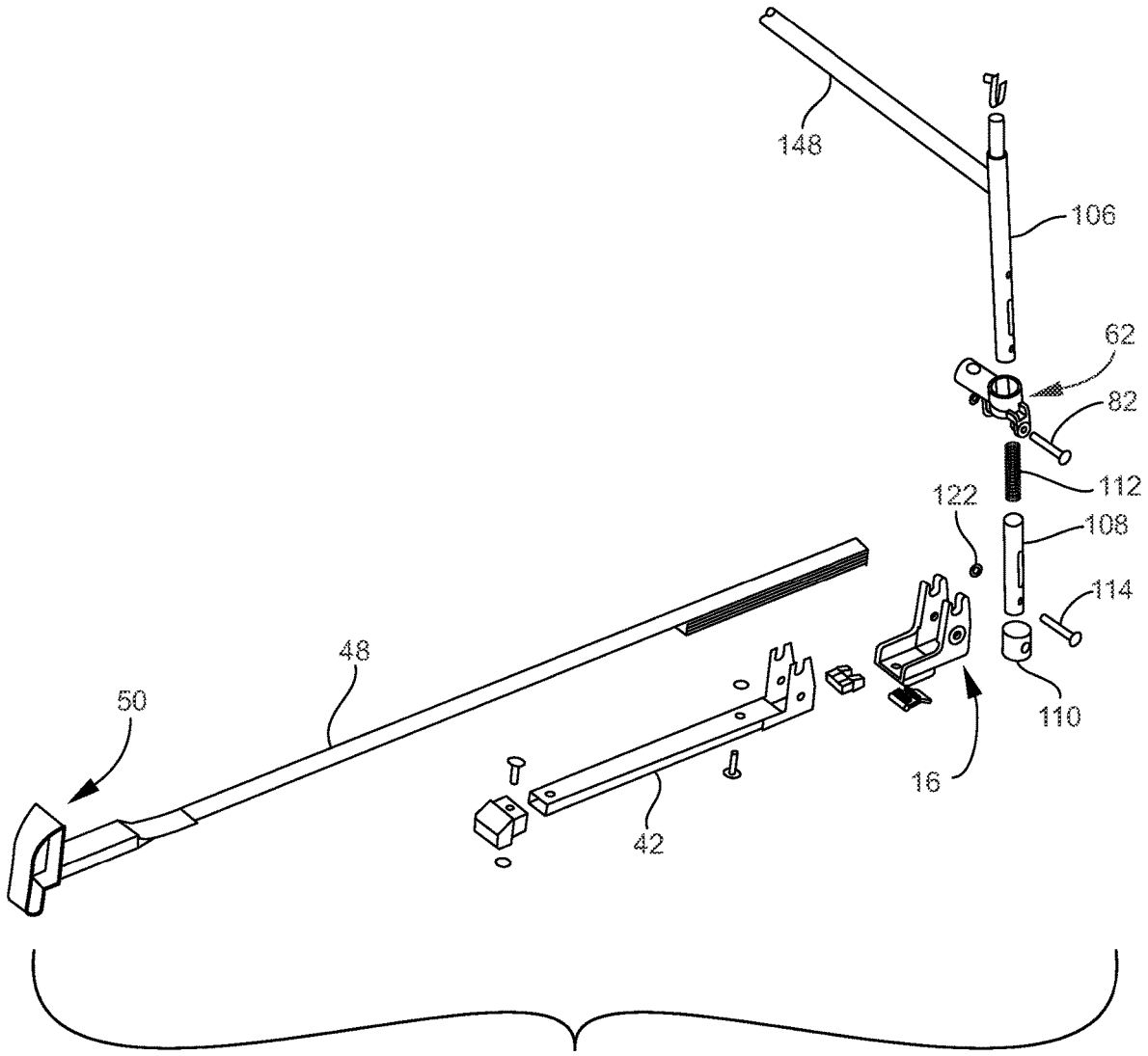
FIG. 12 is a perspective exploded view of the left end of the bottom rail controlled bed rail of FIG. 1.
Figure 14:
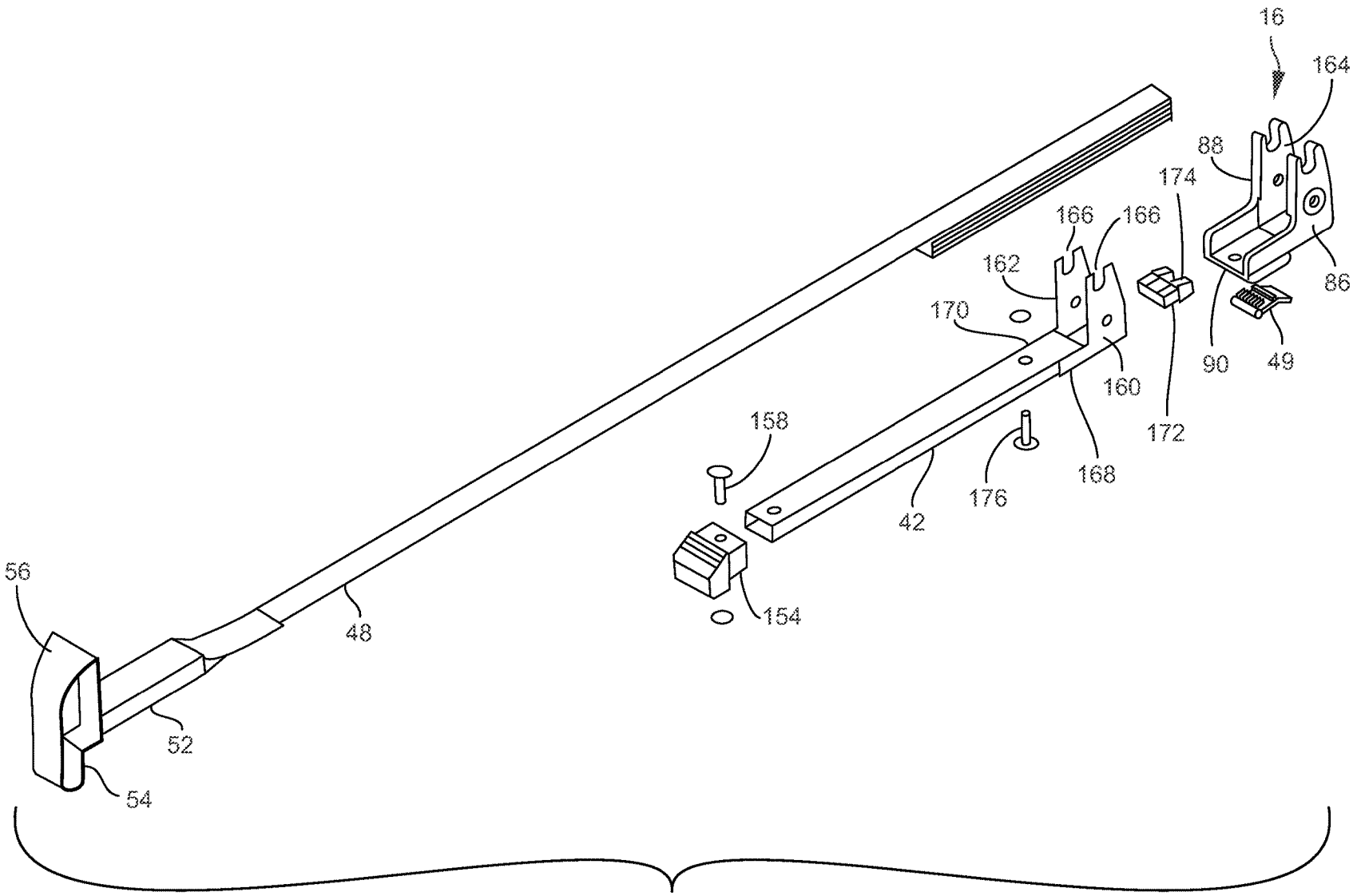
FIG. 14 is a perspective exploded detail view of a portion of the left end of the bottom rail controlled bed rail of FIG. 12.
Figure 15:
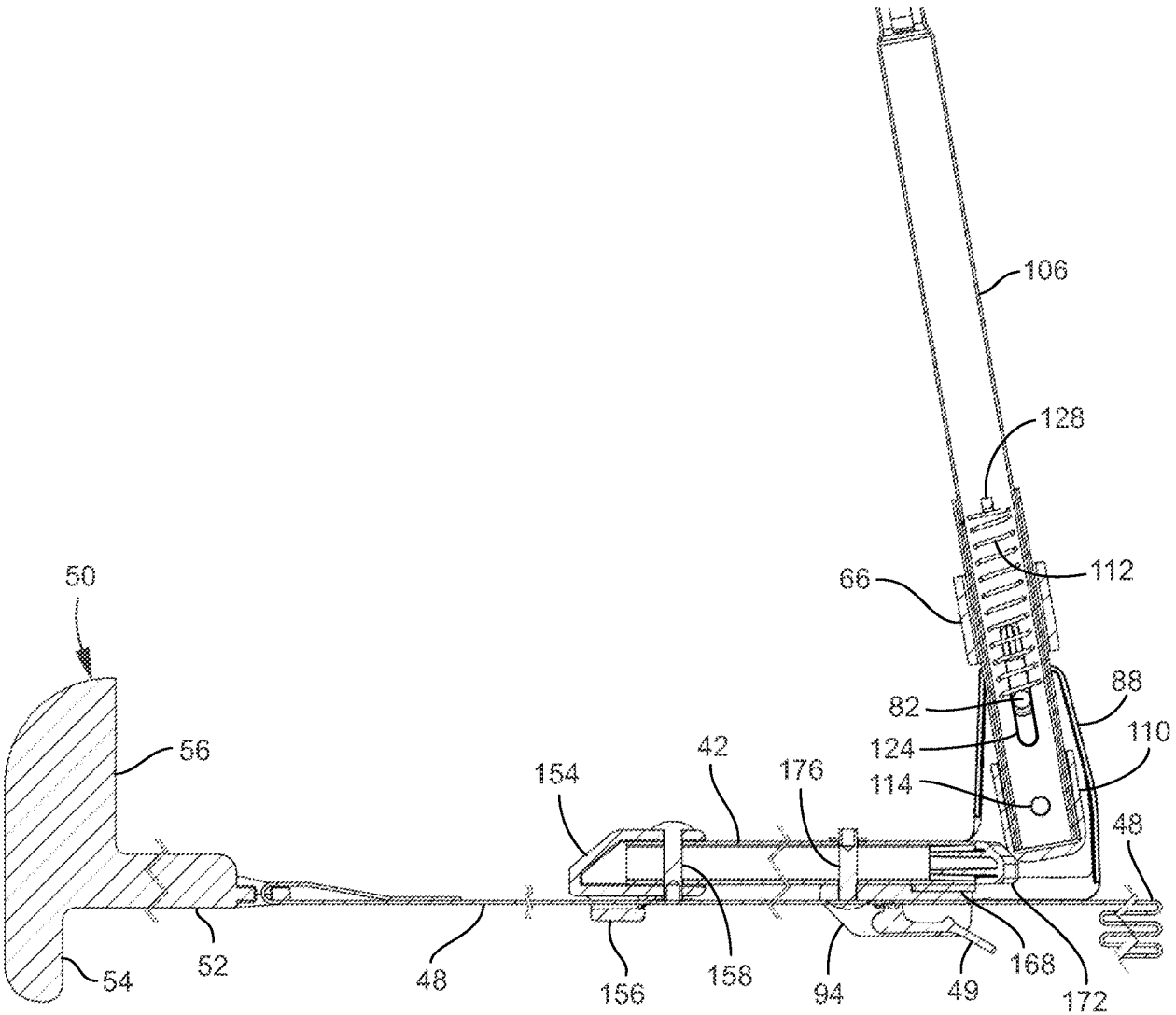
FIG. 15 is a section view of one of the ends of the bottom rail controlled bed rail of FIG. 1.

FIG. 12 shows an exploded view of the leg frame portion 14 in relation to a portion of guard rail frame portion 12. FIG. 14 shows a detail exploded view of the leg frame portion 14. FIG. 15 shows a sectional view of the leg frame portion 14. Leg frame portion 14 includes the tubular leg 42. A female distal cap 154 closes off the distal end male portion 46 of the tubular leg 42. Distal cap 154 includes a depending slotted portion 156 having a slot for receiving flexible strap 48. Distal cap 154 is engaged to the distal end portion 46 by a pin connector 158. Ridges 94 at the proximal end of tubular leg 42 are spaced apart and form a guide for strap 48, which ridges 94 also mount therebetween the pivotable toothed catch mechanism 49.

Bases 16, 18 include a plastic component and a metal component. The metal component includes a pair of metal outer and inner plates 160, 162 that are one-piece and integral with tubular leg 42 having been, for example, fixed to the tubular leg 42 by, for example, welding. The plastic component is the pair of plastic outer and inner plates 86, 88. Each of the upward extensions 98 of the outer and inner plates 86, 88 have inner faces 164 that form tailored receptacles for the metal outer and inner plates 160, 162. The tailored receptacles have raised or inwardly extending perimeter portions that hold the metal plates 160, 162 therein. The seat engaging pieces 78 are seated upon the U-shaped seats 100 and may further be seated upon the metal U-shaped seats 166 formed in the metal outer and inner plates 160, 162 and that can be flush with the plastic formed U-shaped seats 100. Rear plate 90 is plastic and serves as a mount for the proximal end portion 44 of the tubular leg 42 and for a metal rear plate 168 that extends between the metal outer and inner plates 160, 162 and is engaged, such as by being welded, to the underside of tubular leg 42. The inside faces of rearward extensions 170 of outer and inner plates 160, 162 are engaged, such as by welding, to sides of the tubular leg 42. A male cap 172 is inserted into the proximal open end of tubular leg 42 and includes a front curved seat 174 for receiving the lower end cap 110 of the respective lower end cap 110 of the left or right end frame member 22, 24 when the guard rail frame portion 12 is in the down position. Curved seat 174 is a stop for the lower end cap 110 and its respective left or right end frame member 22, 24 when the guard rail frame portion 12 is swung down. Each of plastic inner plates 86, 88 and metal inner and outer plates 160, 162 have aligned through holes for pin connector 114. Rear plate 90 and hence outer and inner plates 86, 88 are engaged to tubular leg 42 by pin connector 176 that extends through a hole in rear plate 90 and that further extends through openings in the bottom and top of tubular leg 42. Metal plates 160, 162 lend a rigidity to left and right bases 16, 18. Plastic plates 86, 88 lend smooth operation to the seating and sliding of seating and sliding assembly 62 on the left and right bases 16, 18 because the seat engaging pieces 78 ride upon plastic portions of the plastic plates 86, 88.

Figure 16:
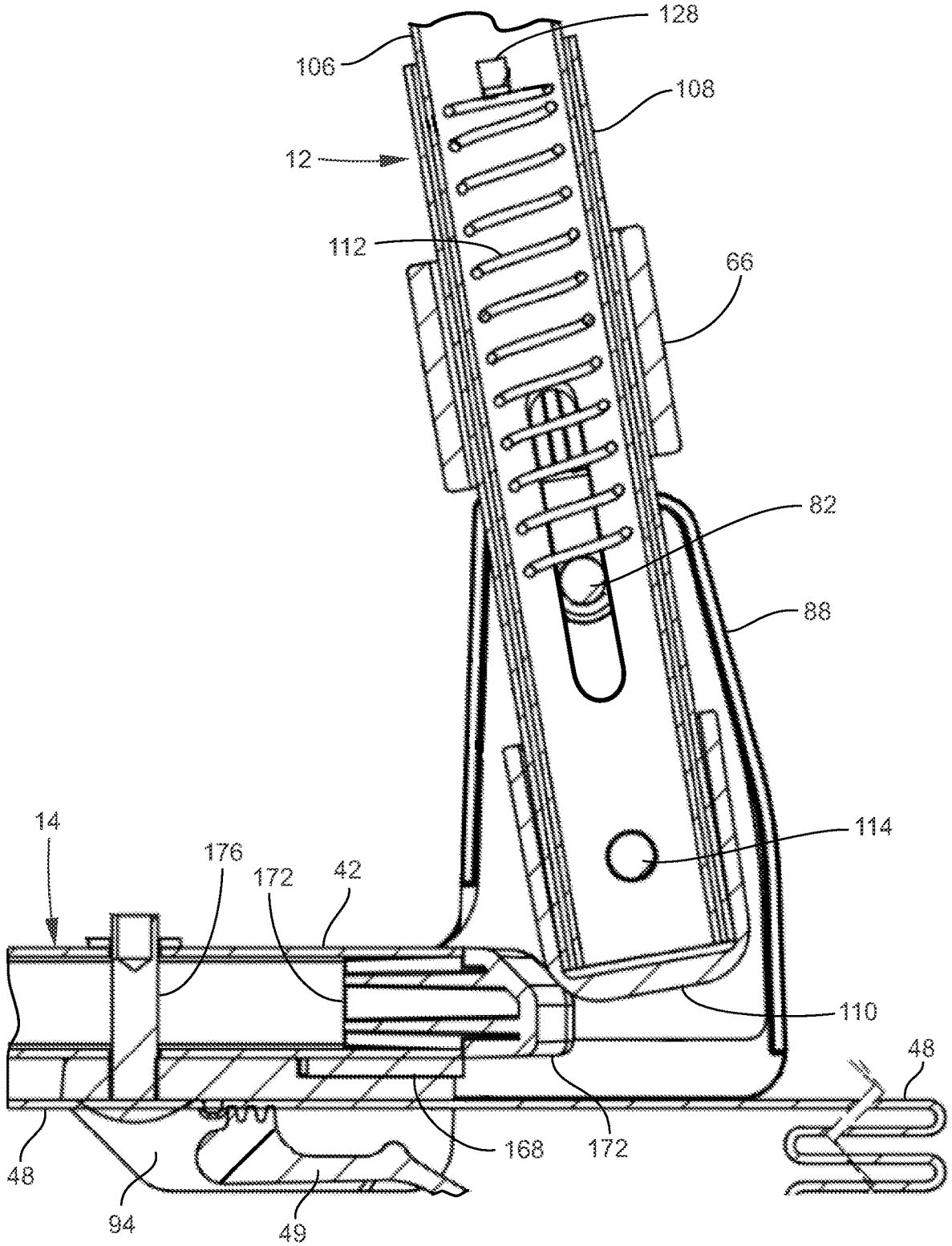
FIG. 16 is a detail section view of a portion of FIG. 15.

FIGS. 15 and 16 are section views of the leg frame portion 14 and guard rail frame portion 12. FIGS. 15 and 16 show the oblique operating position of the guard rail frame portion 12 where the pivoting pin connector 114 and sliding pin connector 82 define an oblique straight line relative to an axis of the tubular leg 42. Pivoting pin connector 114 and sliding pin connector 82 are disposed axially apart on the left end frame member 20. FIG. 16 shows that the bottom ends of each of main tube 106 and base tube 108 reside adjacent to each other at an innermost face of the lower end cap 110.

Figure 17:
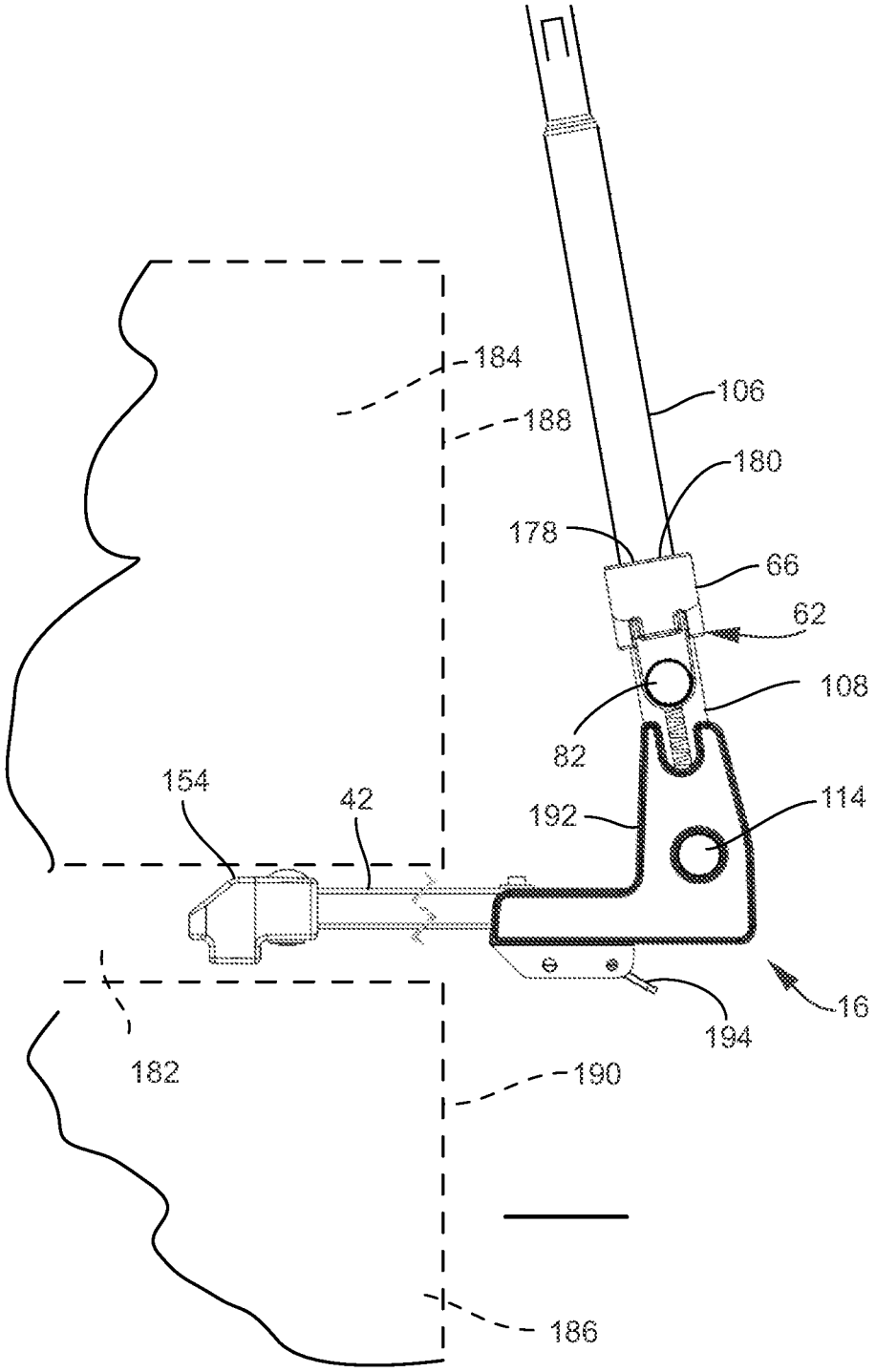
FIG. 17 is an end view of the bottom rail controlled bed rail of FIG. 1 showing the left end of the bottom rail assembly disengaged from the left bottom rail receptor.
Figure 18:
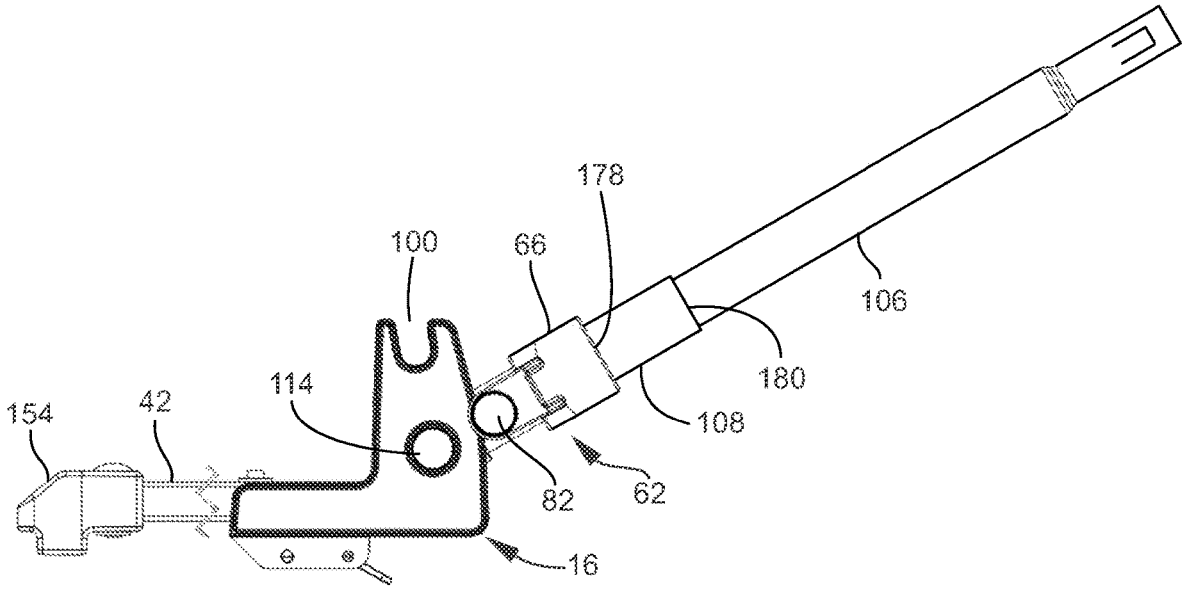
FIG. 18 is an end view of the bottom rail controlled bed rail of FIG. 1 showing the left end of the bottom rail assembly having been displaced from the left bottom rail receptor and the bottom rail controlled bed rail having been swung forwardly.
Figure 19:
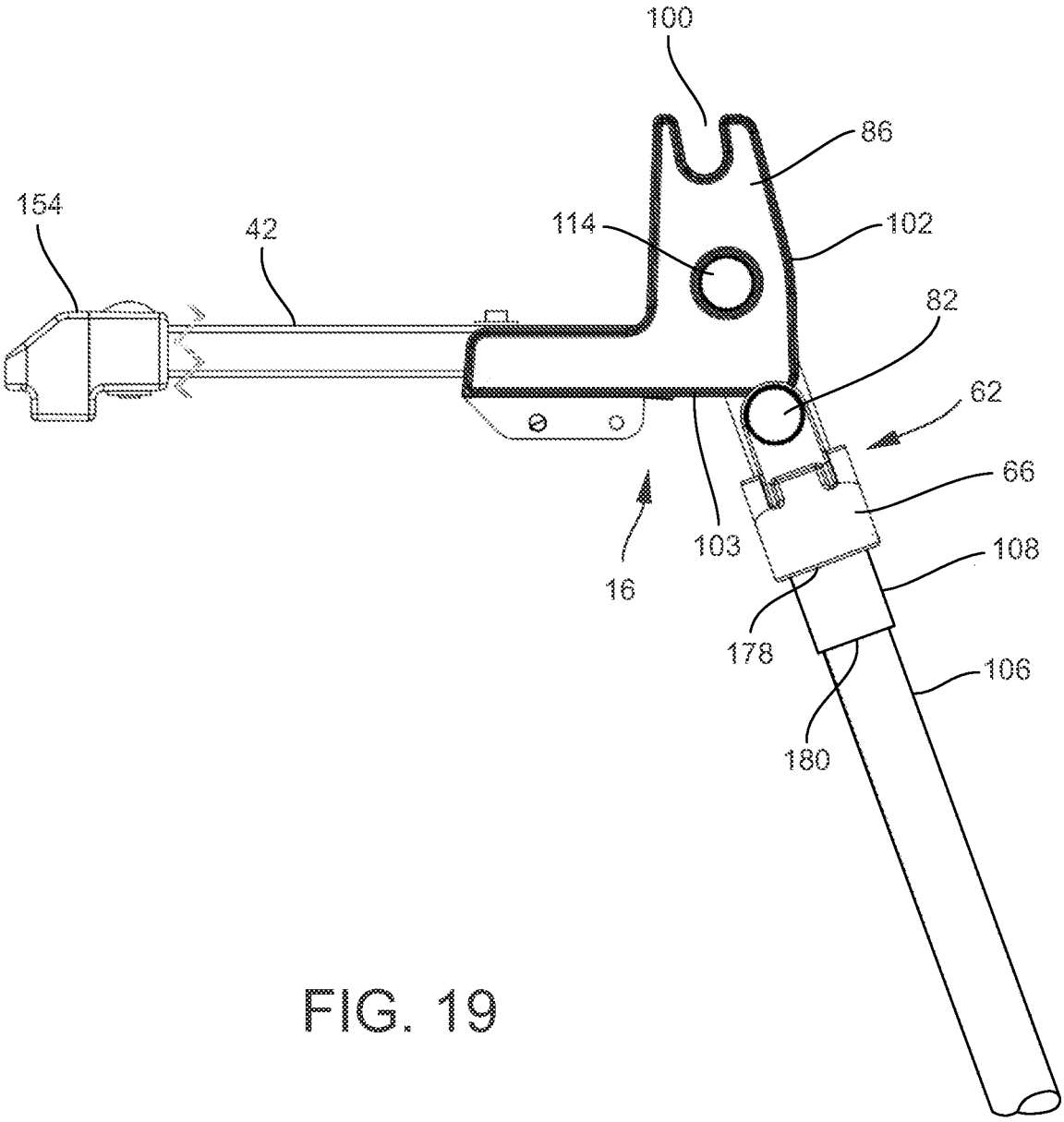
FIG. 19 is an end view of the bottom rail controlled bed rail of FIG. 1 showing the left end of the bottom rail assembly having been displaced from the left bottom rail receptor and the bottom rail controlled bed rail having been swung downwardly.

FIGS. 17, 18, and 19 show the travel of the seating and sliding assembly 62 from after being seated in FIG. 17, to sliding on front edge 102 of plates 86, 88, to sliding on the bottom edge 103 of plates 86, 88. It can be appreciated, by virtue of the coil spring 112, that the seat engaging piece 78 makes contact with the full length of front edge 102 and a portion of bottom edge 103, and that the seat engaging piece 78 makes contact with the junction between front edge 102 and bottom edge 103. Coil spring 112 continually biases or pushes seat engaging piece 78 in the direction of the end cap 110 so as to continually make contact with edges 102, 103 and so as to automatically snap the seat engaging pieces 78 back into the U-shaped seats 100.

In FIG. 17, the distal annular edge 178 of the cylinder 66 is coplanar with the distal annular edge 180 of base tube 108. In FIG. 18, the distal annular edge 178 of the cylinder 66 is spaced from the distal annular edge 180 of base tube 108 by a first distance, and the axis of pin connector 82 is spaced from the axis of pin connector 114 by a second distance. In FIG. 19, the distal annular edge 178 of cylinder 66 is spaced from the distal annular edge 180 by a third distance, and the axis of pin connector 82 is spaced from the axis of pin connector 114 by a fourth distance. The second distance is less than the fourth distance, and thus one would expect that the first distance is hence greater than the third distance, and such is in fact true because in FIG. 19 the cylinder 66 is pushed further from the axis of pin connector 114 by the relatively distant location near the junction of the front edge 102 with the bottom edge 103.

In operation, as shown schematically in FIG. 17, the leg frame portion 14 is pushed into a space 182 between a mattress 184 and a mattress support 186 such as a box frame. The mattress 184 may be lifted somewhat so as to place the counter member 50 on the side of the mattress opposite mattress side 188 and on the side of the mattress support opposite the mattress support side 190. Then the strap 48 is pulled so as to pull the counter member 50 against such opposing sides and so as to relatively pull the guard rail frame portion 12 into a confronting relationship with mattress side 188. In such a confronting relationship one or more of a) the back edges 192 of the plates 86, 88 and b) the rear faces of the left end frame member 22 and right end frame member 24 make contact with the mattress side 188 such that one or more of the a) the back edges 192 of the plates 86, 88, and b) the rear faces of the left end frame member 22 and right end frame member 24 act as a counter member. In such a confronting relationship, the rear face of upper frame member 30 is disposed beyond an uppermost surface of mattress 184 such that guard rail frame portion 12, including its sheeting 31, stop a child from rolling off the mattress 184. In such a confronting relationship, seat engaging pieces 78 are in the U-shaped seats 100 such that guard rail frame portion 12 is fixed relative to leg frame portion 14 such that there is no gap between the upper frame member 30 of the guard rail frame portion 12 and the side 188 of the mattress 184. In such a confronting relationship, strap 48 is fixed in place by swinging upwardly the lever 194 of the toothed catch mechanism 49 to pinch the strap 48 against the bottom of tubular leg 42.

In operation, during sleep, the rear face of upper frame member 30 is disposed beyond an uppermost surface of mattress 182, and a portion of the rear faces of the left end frame member 22 and right end frame member 24 abut the junction of the uppermost surface of mattress 184 and mattress side 188 to as to minimize any gap between the guard rail frame portion 12 and the side 188 of the mattress 184.

In operation, to take the guard rail frame portion 12 away from the side 188 of the mattress 184 for a swing down, the bottommost frame member 20 is lifted such as by lifting left tube 58 or right tube 60 or such as by lifting handle 40. Lifting other portions of the rail portion 12 does not result in a swing down of the guard rail frame portion 12, with such other portions including the upper frame member 30 including upper tube portions 138, 142, left tube portion 130, left main tube 106, right tube portion 134, intermediate tube portions 148, 150, and transition tube portions 140, 144.

In operation, as the bottommost frame member 20 is lifted, the seat engaging pieces 78 of the seating and sliding assembly 62 are lifted out of their respective U-shaped seats 100 and the cylinders 66 begin to slide up their respective base tubes 108. When the seat engaging pieces 78 clear the top of the plates 86, 88, the guard rail frame portion 12 may be pivoted away from the mattress side 188, whereupon the handle 40 can be released and the seat engaging pieces 78 begin to slide upon the front edges 102 of plates 86, 88. Then, as the guard rail frame portion 12 continues to pivot and drop down, the seat engaging pieces 78 slide further down the front edges of the plates 86, 88, through the junctions of edges 102 and 103, and onto the bottom edges 103 of plates 86, 88, whereupon the mattress side 188 is clear of the guard rail frame portion 12 and the guard rail frame portion 12 confronts the mattress support side 190. In this position, because of the coil spring 112, the seat engaging pieces 78 continue to abut the bottom edges 103.

In operation, to swing the guard rail frame portion 12 back to an operating position, any portion of the guard rail frame portion 12 may be held to swing or pivot the guard rail frame portion 12 about pivot connection or connector pin 114. Since the seat engaging piece 78 is spring biased by coil spring 78 toward the end cap 110, the seat engaging piece 78 travels off the bottom edge 103, over the junction of the edges 103, 102, up the front edge 102, onto the tops of plates 86, 88, and then snaps automatically, driven by coil spring 112, into U-shaped seats 100 whereupon the guard rail frame portion 12 is fixed into its oblique upright position relative to leg frame portion 14 against the side 188 of mattress 184.

Figure 20:
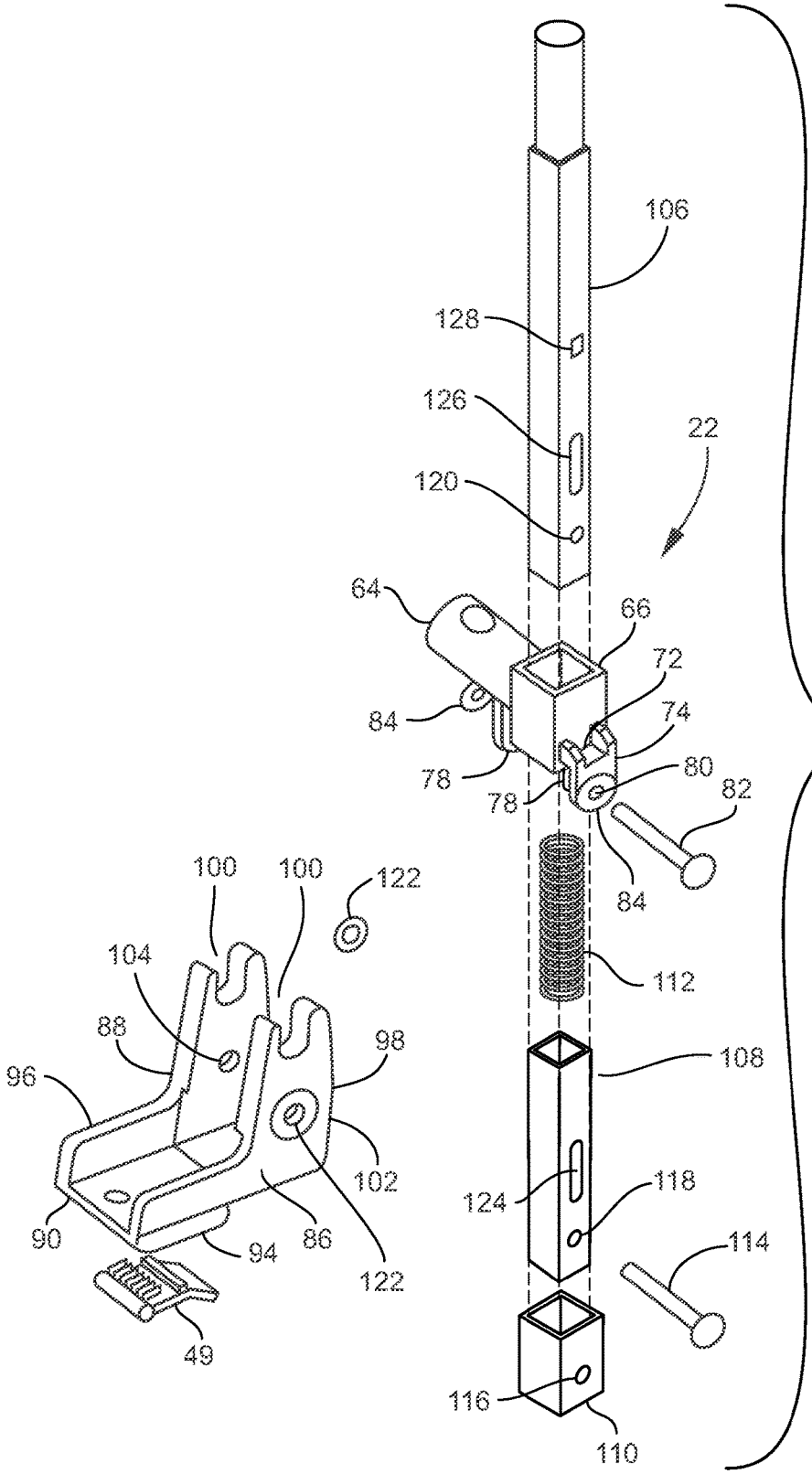
FIG. 20 is a perspective exploded detail view of an alternate portion to the portion of the left end of the bottom rail controlled bed rail shown in FIG. 13, where the alternate portion of the left end of the bottom rail controlled bed rail includes square tubing.

FIG. 20 shows an alternate portion to the portion of the left end of the bottom rail controlled bed rail shown in FIG. 13, where the alternate portion of the left end of the bottom rail controlled bed rail includes square tubing. In other words, as shown in FIG. 20, main tube 106 is square in section with the exception of the male member 196 that is circular in section. Male member or male connector 196 engages the female open end of left tube portion 130 when the square main tube 106 of FIG. 20 is on the left side of the bed rail 10. When on the right side of the bed rail 10, the male member 196 of square main tube 106 of FIG. 20 engages the female open end of right tube portion 134. When employed on the left side of the bed rail 10, the square main tube 106 of FIG. 20 is integral with intermediate tube 148, with the intermediate tube 148 extending inwardly from below the male connector 196, as shown in FIG. 9. When employed on the right side of the bed rail 10, the square main tube 106 of FIG. 20 is integral with intermediate tube 150, with the intermediate tube 150 extending inwardly from below the male connector 196, as shown in FIG. 9. Coil spring 112 is disposed in square main tube 106 of FIG. 20. Square main tube 106 of FIG. 20 includes cross pin 128, the pair of slots 126, and the pair of openings 120.

As further shown in FIG. 20, structure 66 is not a cylindrical receptor but a receptor 66 that is square in section. The square receptor 66 of FIG. 20 is part of the seating and sliding assembly 62. Square receptor 66 of FIG. 20, like the cylindrical receptor 66 of FIG. 13, is a through receptor. Square receptor 66 of FIG. 20 is integral and one-piece with the pair of outward extensions 72, the pair of downward extensions 74, tube receptor 64, and seat engaging pieces 78.

As further shown in FIG. 20, base tube 108 is square in section. Square base tube 108 of FIG. 20 includes the pair of slots 124 and the pair of openings 118.

As further shown in FIG. 20, lower end cap 110 is square in section. Square lower end cap 110 of FIG. 20 includes the openings 116.

Like the structure of FIG. 13, square lower end cap 110 receives square base tube 108, which receives square main tube 106, which through upper male connector 196 engages one of the left tube portion 130 or right tube portion 134. Square receptor 66 receives and slides upon base tube 108.

When their compositions, lengths, widths, and depths are the same or similar, square elements 106, 66, 108, and 110 of FIG. 20 are stronger than their associated cylindrical elements 106, 66, 108, and 110 of FIG. 13.

Figure 21B:
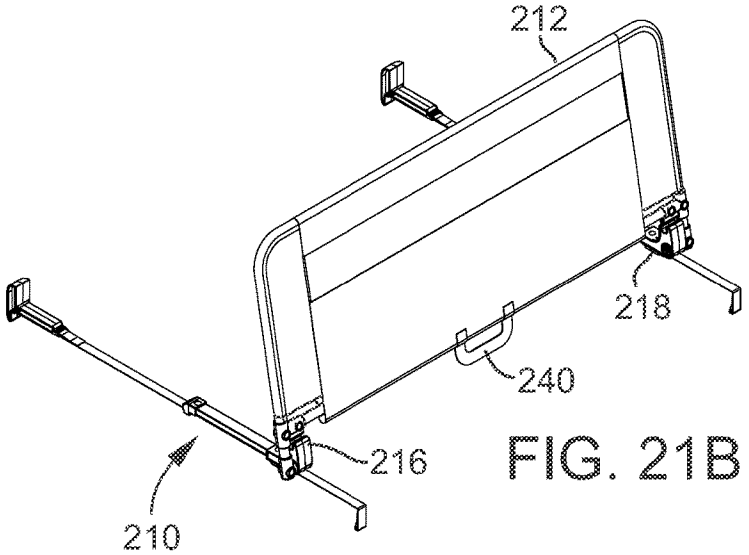
FIG. 21B is a perspective view of the bottom rail controlled bed rail of FIG. 21A showing the bottom rail assembly having been slid up the right and left end support members of the bottom rail controlled bed rail and out of engagement with the bottom rail receptors.
Figure 21D:
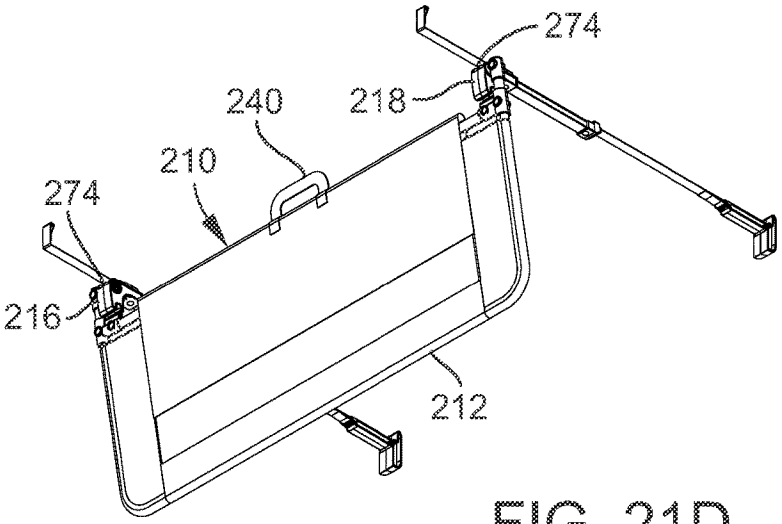
FIG. 21D is a perspective view of the bottom rail controlled bed rail of FIG. 21A showing the bottom rail controlled bed rail having been swung to a down position after the bottom rail assembly has been displaced from the bottom rail receptors.
Figure 21A:
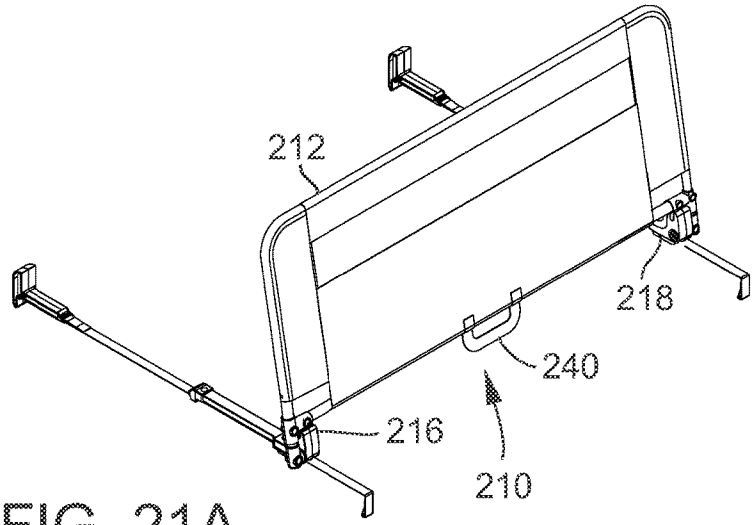
FIG. 21A is a perspective view of an alternate embodiment of the present bottom rail controlled bed rail showing the bottom rail controlled bed rail in an operating position where the bottom rail assembly is engaged to the bottom rail receptors.
Figure 21C:
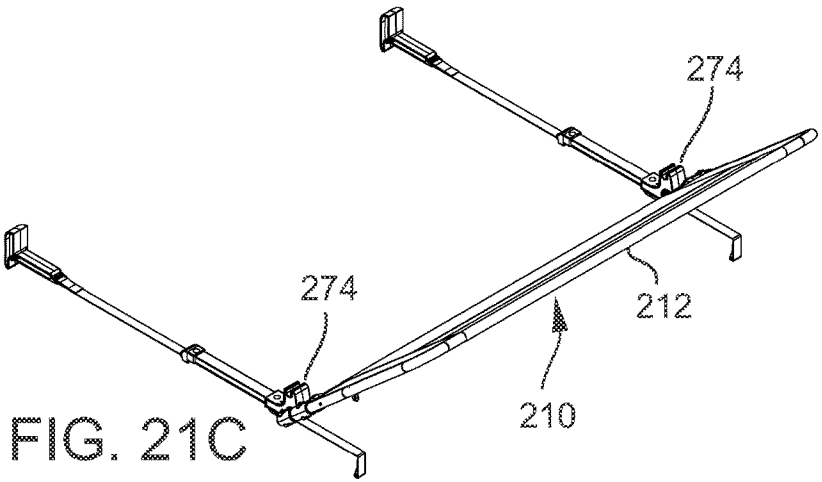
FIG. 21C is a perspective view of the bottom rail controlled bed rail of FIG. 21A showing the bottom rail controlled bed rail having been swung forwardly after the bottom rail assembly has been displaced from the bottom rail receptors.

As shown in FIG. 21A, in an alternate embodiment of the present bottom rail controlled bed rail is indicated by the reference numeral 210.

Bed rail 210 includes a first frame portion 212 or guard rail frame portion 212, a second frame portion 214 or a leg frame portion 214, a left base 216, and a right base 218. Guard rail frame portion 212 is engaged to the leg frame portion 214 through the left and right bases 216, 218. The guard rail frame portion 212 includes a lower frame member 220 that is slideable up left and right end frame members 222, 224 of the guard rail frame portion 212. As the lower frame member 220 is slideable up the left and right frame members 222, 224, the lower frame member 220 disengages itself from the left and right bases 216, 218, thereby permitting the guard rail frame portion 212 as a whole to swing down relative to the left and right bases 216, 218 and relative to the leg frame portion 214. As the guard rail frame portion 212 swings down, the guard rail frame portion 212 remains pivotally engaged to the left and right bases 216, 218 through left and right pivot connections 226, 228 between the lower ends of the left and right end frame members 222, 224 and the left and right bases 216, 218. Left and right pivot connections 226, 228 are, for example, shown in FIG. 30. Each of the pivot connections 226, 228 is made up of a pivot 278 and a pivot receptor 282. Pivot receptor 282 is formed in each of the bases 216, 218. Pivot 278 is integral with tube receptor 276. Tube receptor 276 receives and engages the lower end of each of the left end frame member 222 and the right end frame member 224.

Guard rail frame portion 212 includes the lower frame member or bottom rail 220, the left end frame member 222, the right end frame member 224, and an upper frame member 230. Members 220, 222, 224 and 230 are tubular and formed of metal. Guard rail frame portion 212 forms generally the shape of a rectangle where adjacent sides are of unequal length. Left end frame member 222, upper frame member 230, and right end frame member 224 form the shape of an inverted U.

Guard rail frame portion 212 is relatively rigid when the lower frame member 220 is seated in the left and right bases 216, 218. Guard rail portion 212 remains relatively rigid when lower frame member 220 slides upwardly and downwardly on the left and right end frame members 222, 224. Lower frame member 220 is spring biased toward the lower ends or distal ends or pivoting ends of the left and right end frame members 222, 224. Lower frame member 220 slides a minimal amount on the left and right end frame members 222, 224 such that lower frame member 220 remains positioned on lower end portions or distal end portions or pivoting end portions of the left and right end frame members 222, 224 whether the lower frame member 220 is seated or not seated in the left and right bases 216, 218. The further away that the lower frame member 220 is from a seated position in the left and right bases 216, 218, the greater the spring biased force is that seeks to return the lower frame member 220 toward the absolute lower ends or absolute distal ends or the absolute pivoting ends of the left and right end frame members 222, 224.

Figure 22:
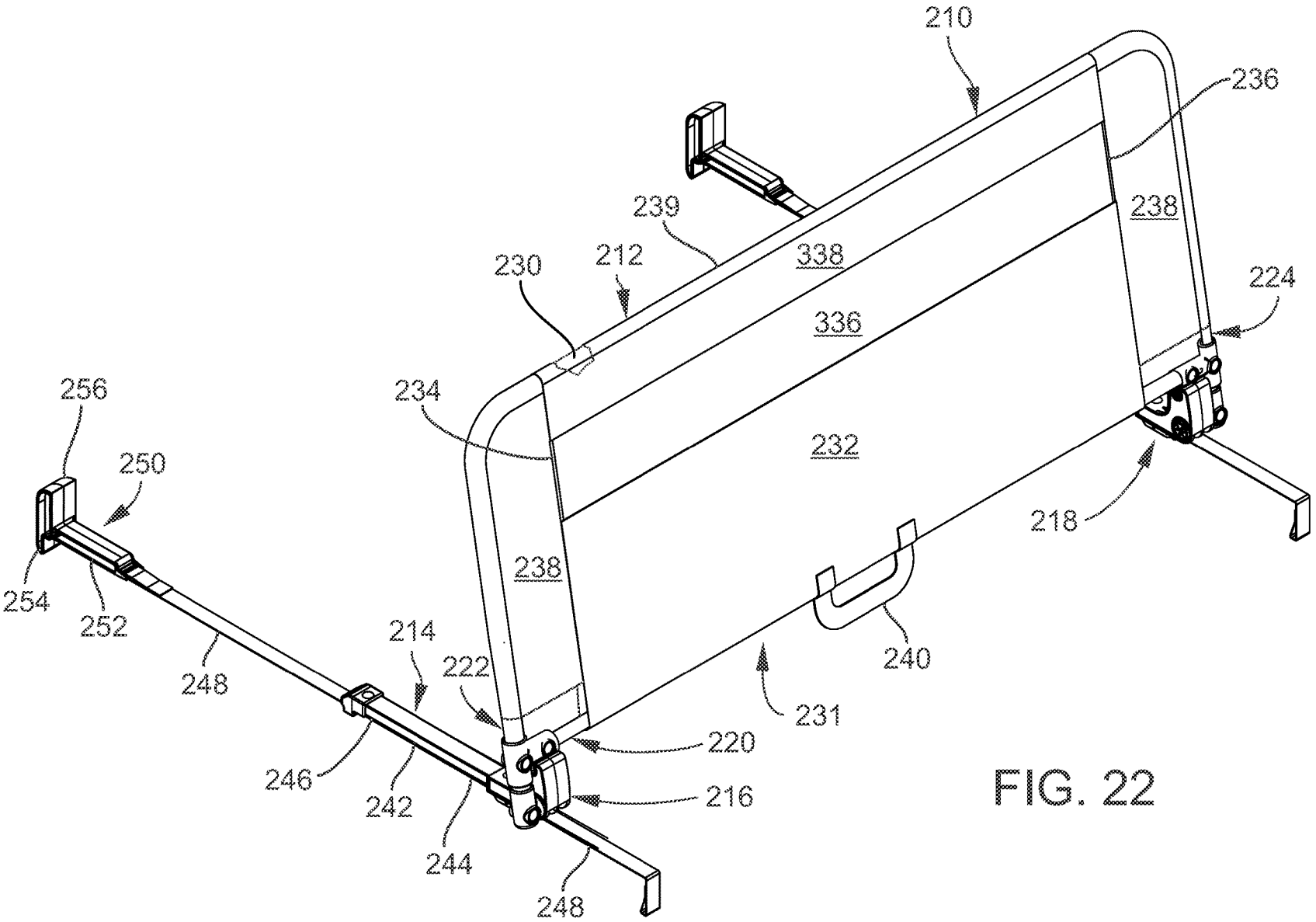
FIG. 22 is a detail view of FIG. 21A.
Figure 23:
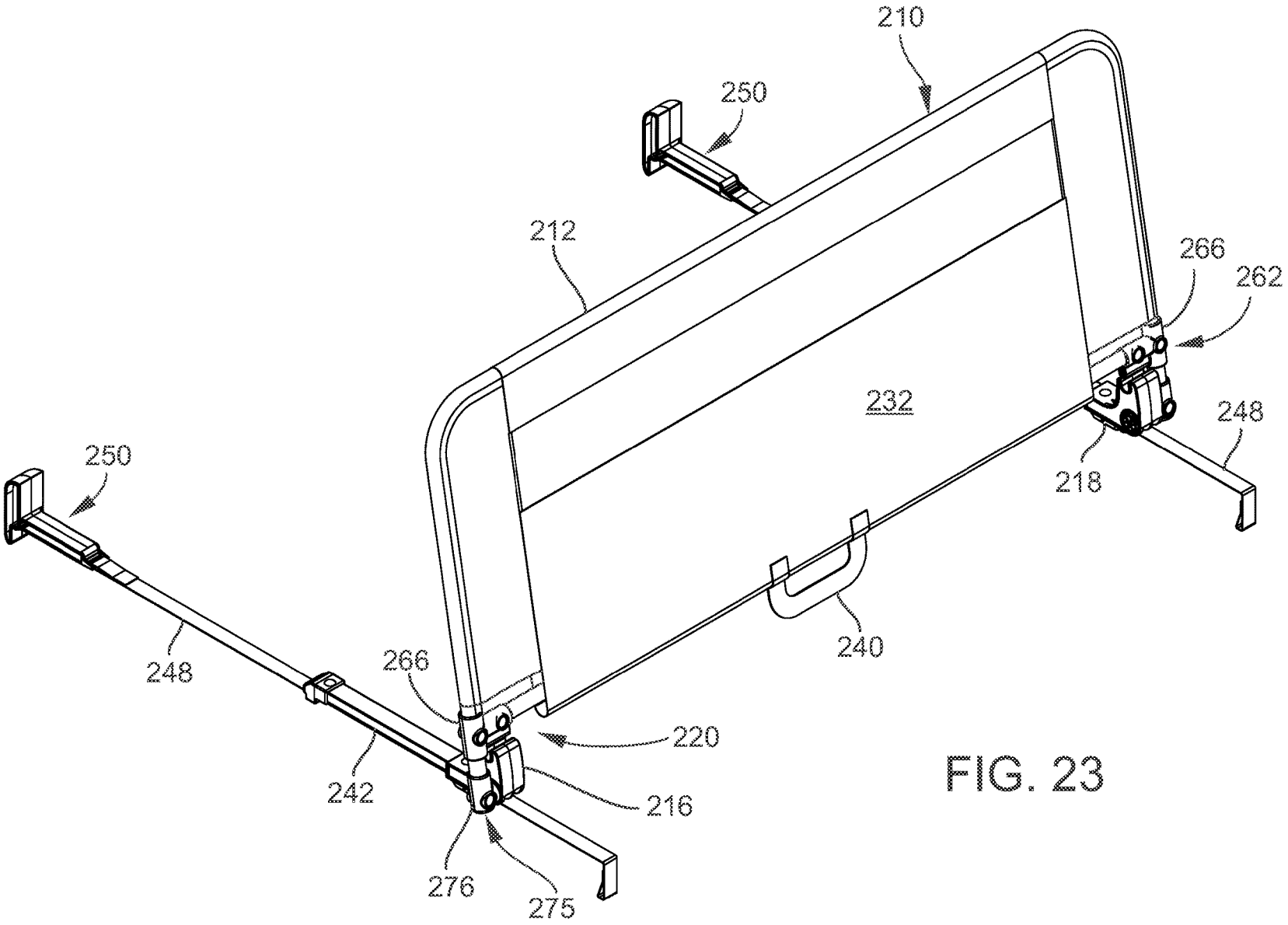
FIG. 23 is a detail view of FIG. 21B.
Figure 24:
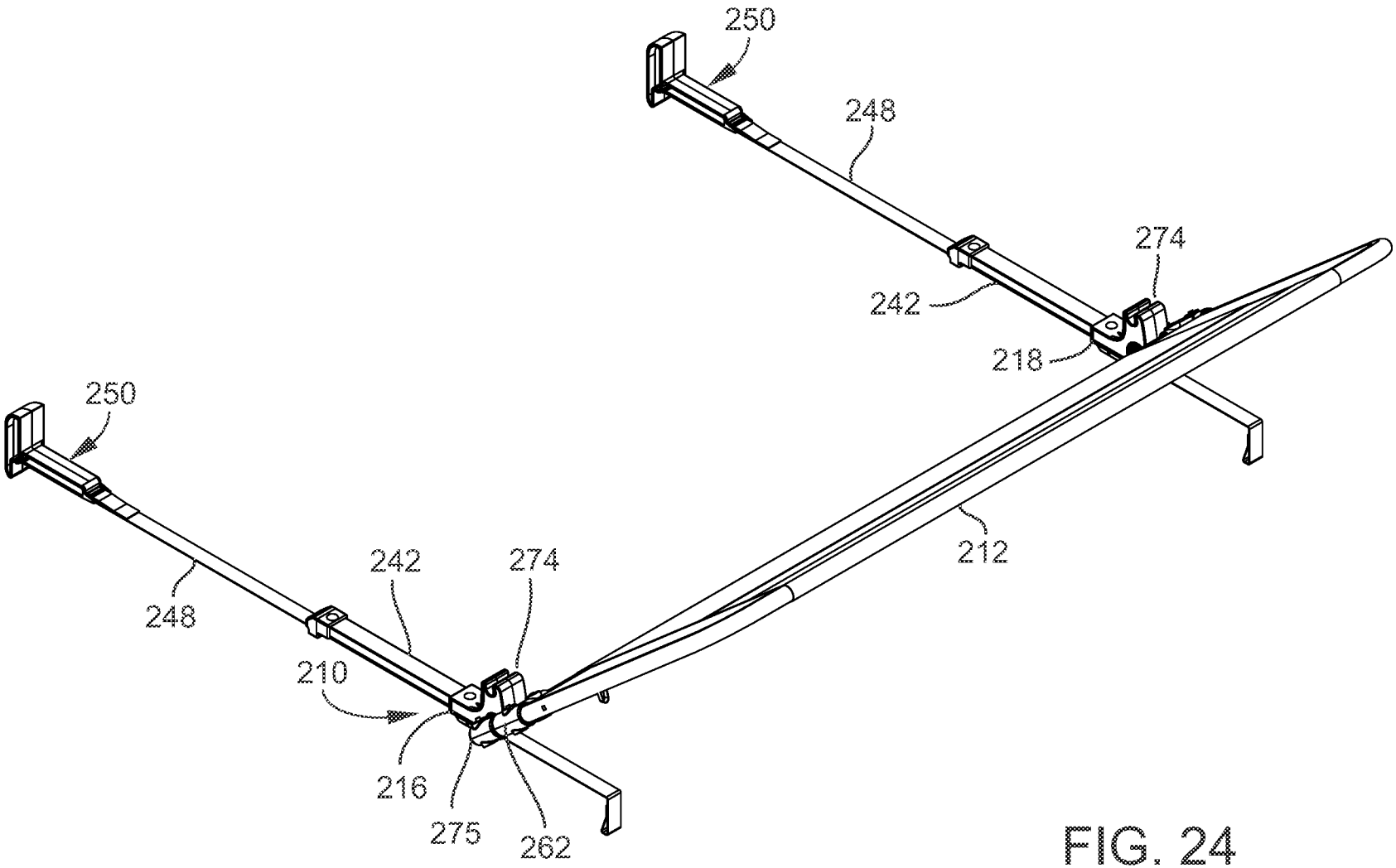
FIG. 24 is a detail view of FIG. 21C.
Figure 25:
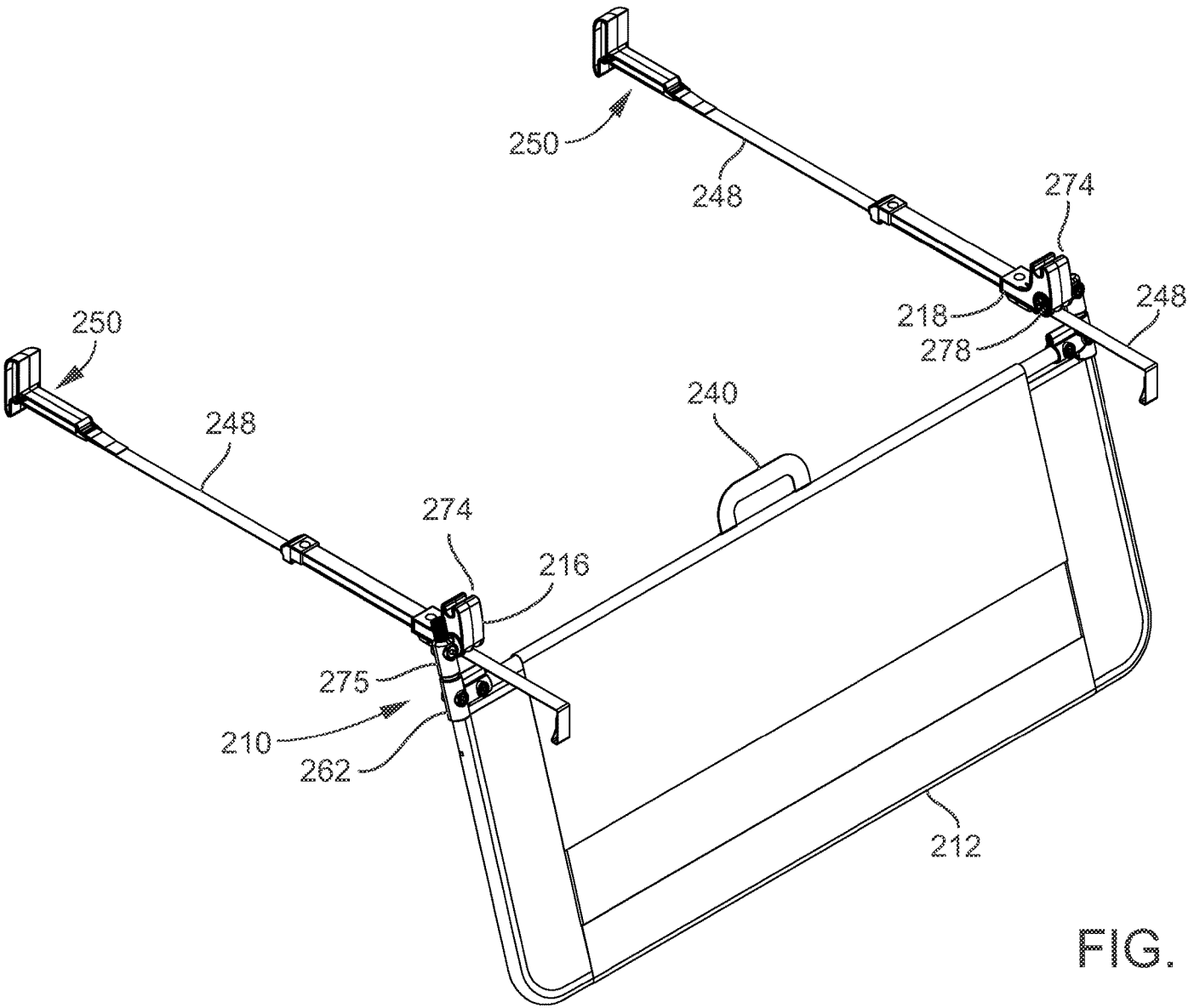
FIG. 25 is a detail view of FIG. 21D.

FIG. 22 shows sheeting 231 engaged to the guard rail frame portion 212. Sheeting 231 includes a first sheeting portion 232 formed in the shape of a loop and engaged between the lower frame portion 220 and the upper frame portion 230. First sheeting portion 232 includes left edge portions 234 that are spaced from left end frame member 222. First sheeting portion 322 includes right edge portions 236 that are spaced from right end frame member 224. First sheeting portion 232 engages straight portions of the lower and upper frame members 220, 230. First sheeting portion 232 includes a front panel of sheeting and a rear panel of sheeting.

Sheeting 231 includes second sheeting portions 238. Each of the second sheeting portions 238 is a half-loop. One of the second sheeting portions 238 loops about left end frame member 222 and a portion of the upper frame member 230. The other of the second sheeting portions 238 loops about the right end frame member 224 and a portion of the upper frame member 230. Each of the sheeting portions 238 includes two inner vertical edges, one of which is engaged to the front panel of first sheeting portion 232 and one of which is engaged to the rear panel of first sheeting portion 232. Sheeting portions 232, 238 may be engaged, for example, by stitching.

Sheeting 231 includes an inverted U-shaped sleeve 239 through which is slipped left end frame member 222, upper frame member 230, and right end frame member 224. Sheeting portion 232 includes a portion of U-shaped sleeve 239. Each of the sheeting portions 238 includes a portion of U-shaped sleeve 239. Sleeve 239 is tubular with a left open end adjacent to the left outer end of the lower frame member 220 and with a right open end adjacent to the right outer end of the lower frame member 220.

Guard rail frame portion 212 includes a handle 240. Handle 240 is one mechanism by which the lower frame member 220 can be lifted up and unseated from the left and right bases 216, 218. Handle 240 may be directly engaged to lower frame member 220 through a pair of openings formed in sheeting portion 232. Handle 240 may be directly engaged to sheeting portion 232 which in turn is directly engaged to lower frame member 220. Handle 240 may be integral and one-piece with the sheeting portion 232. Handle 240 may be integral and one-piece with the lower frame member 220. Handle 240 is formed in the shape of an inverted U. Handle 240 is positioned intermediate left and right outer end portions of the lower frame member 220. A center of the handle 240 is vertically aligned with a center of the lower frame member 220 such that, when the user lifts up on the handle 240, the left and right end portions of the lower frame member 220 are unseated at the same time from the left and right bases 216, 218. Handle 240 is preferably formed of a flexible fabric material such that handle 240 can flex forwardly, rearwardly, and from side to side. If desired, handle 240 may be tubular and formed of metal.

FIG. 22 further shows leg frame portion 214. Leg frame portion 214 includes a pair of tubular legs 242 that are rigidly engaged to the left and right bases 216, 218. Each of the tubular legs 242 includes a proximal end portion 244 and a distal end portion 246. Extending from underneath the distal end portion 246 is a flexible strap 248 that in turn is engaged to a counter member 250. Counter member 250 is a three portion rigid piece having a planar body 252, a downward extension 254 confronting the far side of the mattress support or box spring, and an upward extension 256 for confronting the far side of the mattress. Planar body 252 is sandwiched between the mattress and the mattress support. Strap 248 travels underneath the tubular leg 242 from the distal end portion 246 to the proximal end portion 244 where strap 248 is engaged by a catch mechanism 249 such that the length of strap 248 can be adjusted. For example, the effective length of strap 248 can be reduced to draw the counter member extensions 254, 256 tightly against the sides of the mattress support and mattress, whereupon the strap 248 can be fixed by the catch mechanism 249 to maintain the tightness between the upward extensions of the left and right bases 216, 218 and the counter member extensions 254, 256. One or more of a) the rear faces of the upward extensions of the left and right bases 216, 218 and b) the left and right end frame members 222, 224 act as counter members on the near side of the mattress.

Figure 26B:
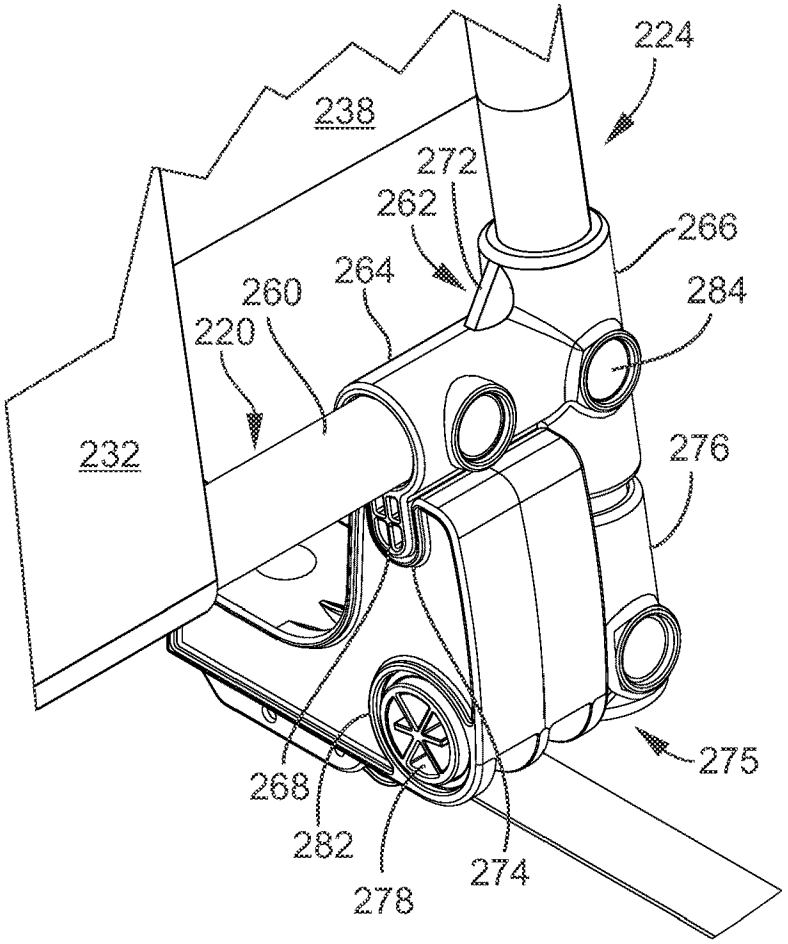
FIG. 26B shows a detail perspective view of the right end portion of the bottom rail assembly of FIG. 22 engaged to the right bottom rail receptor of FIG. 22.
Figure 26A:
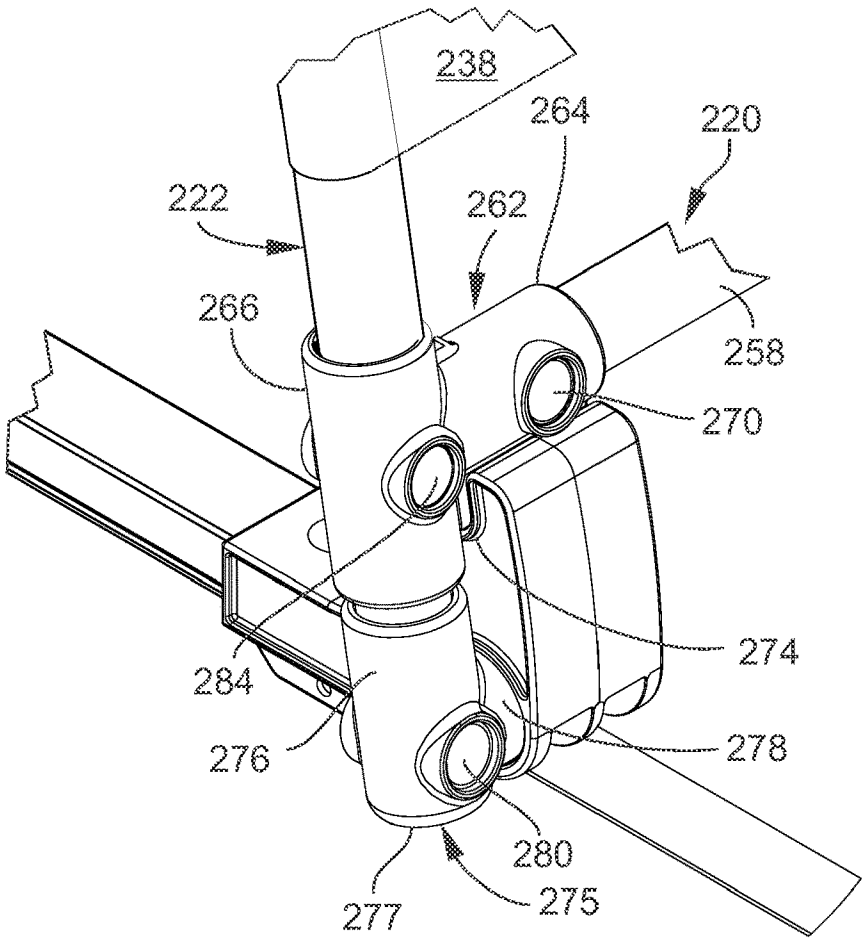
FIG. 26A shows a detail perspective view of the left end portion of the bottom rail assembly of FIG. 22 engaged to the left bottom rail receptor of FIG. 22.
Figure 27B:
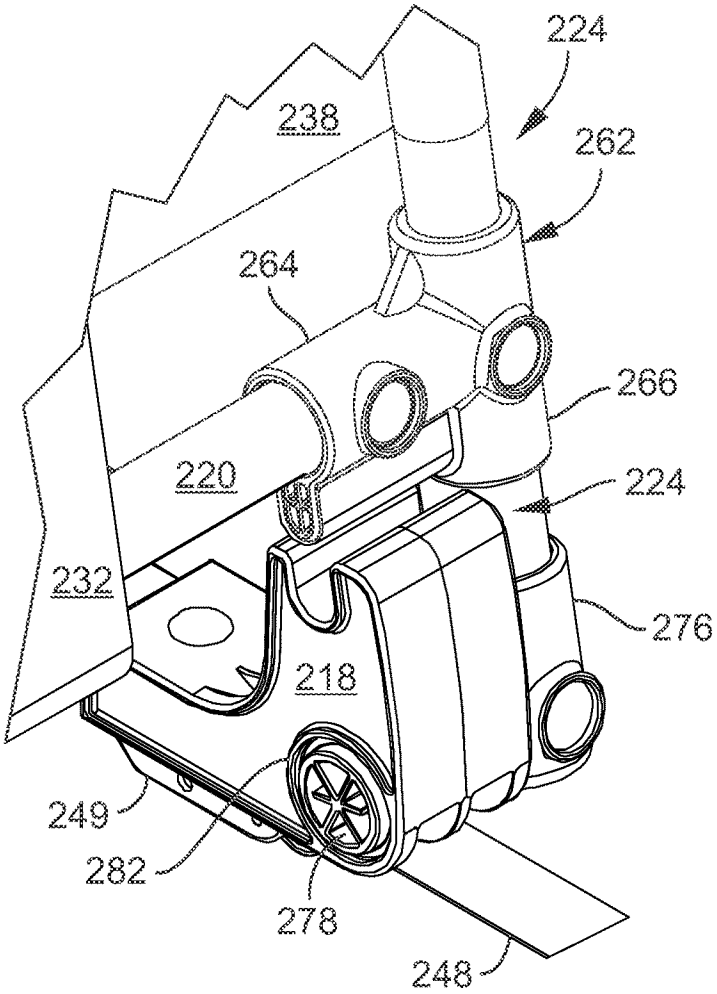
FIG. 27B shows a detail perspective view of the right end portion of the bottom rail assembly of FIG. 23 having been slid up the right end support member of the bottom rail controlled bed rail and out of engagement with the right bottom rail receptor of FIG. 23.
Figure 27A:
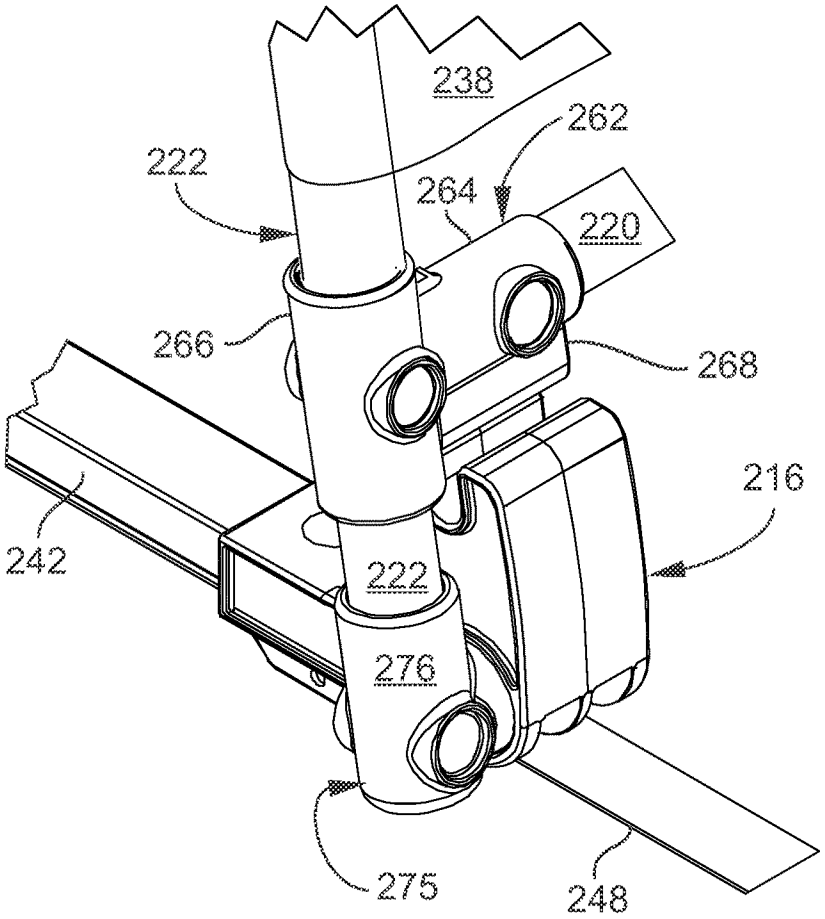
FIG. 27A shows a detail perspective view of the left end portion of the bottom rail assembly of FIG. 23 having been slid up the left end support member of the bottom rail controlled bed rail and out of engagement with the left bottom rail receptor of FIG. 23.
Figure 28B:
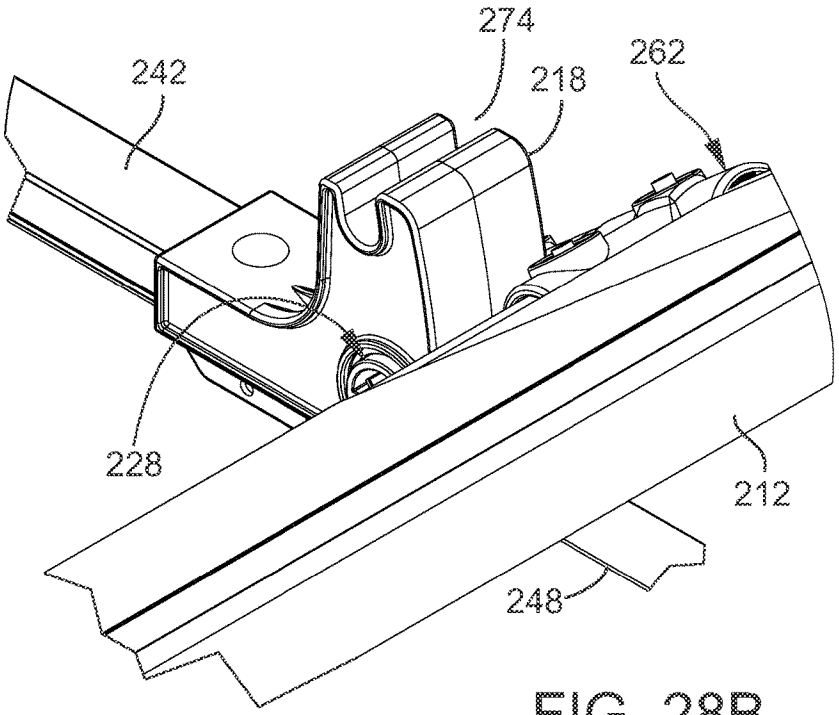
FIG. 28B shows a detail perspective view of the right end portion of the bottom rail assembly of FIG. 24 having been displaced from the right bottom rail receptor of FIG. 24.
Figure 28A:
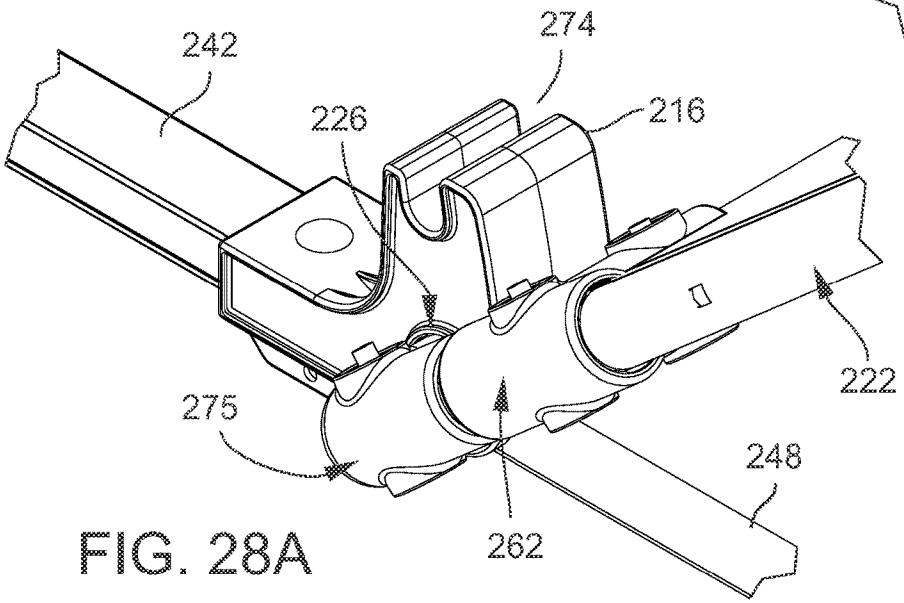
FIG. 28A shows a detail perspective view of the left end portion of the bottom rail assembly of FIG. 24 having been displaced from the left bottom rail receptor of FIG. 24.
Figure 29B:
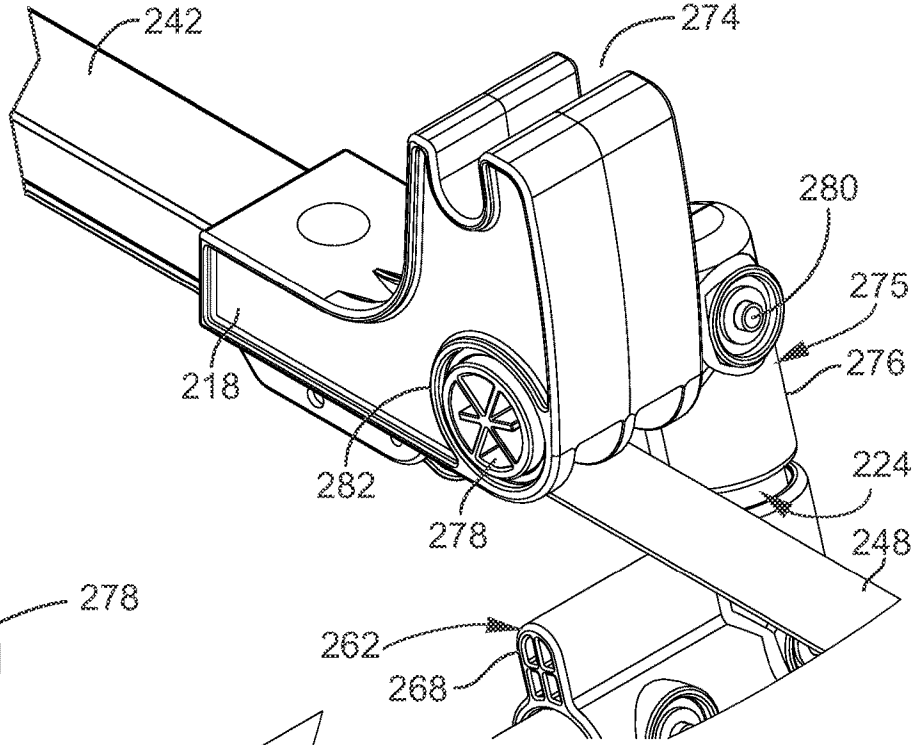
FIG. 29B shows a detail perspective view of the right end portion of the bottom rail assembly of FIG. 25 having been displaced from the right bottom rail receptor of FIG. 25.
Figure 29A:
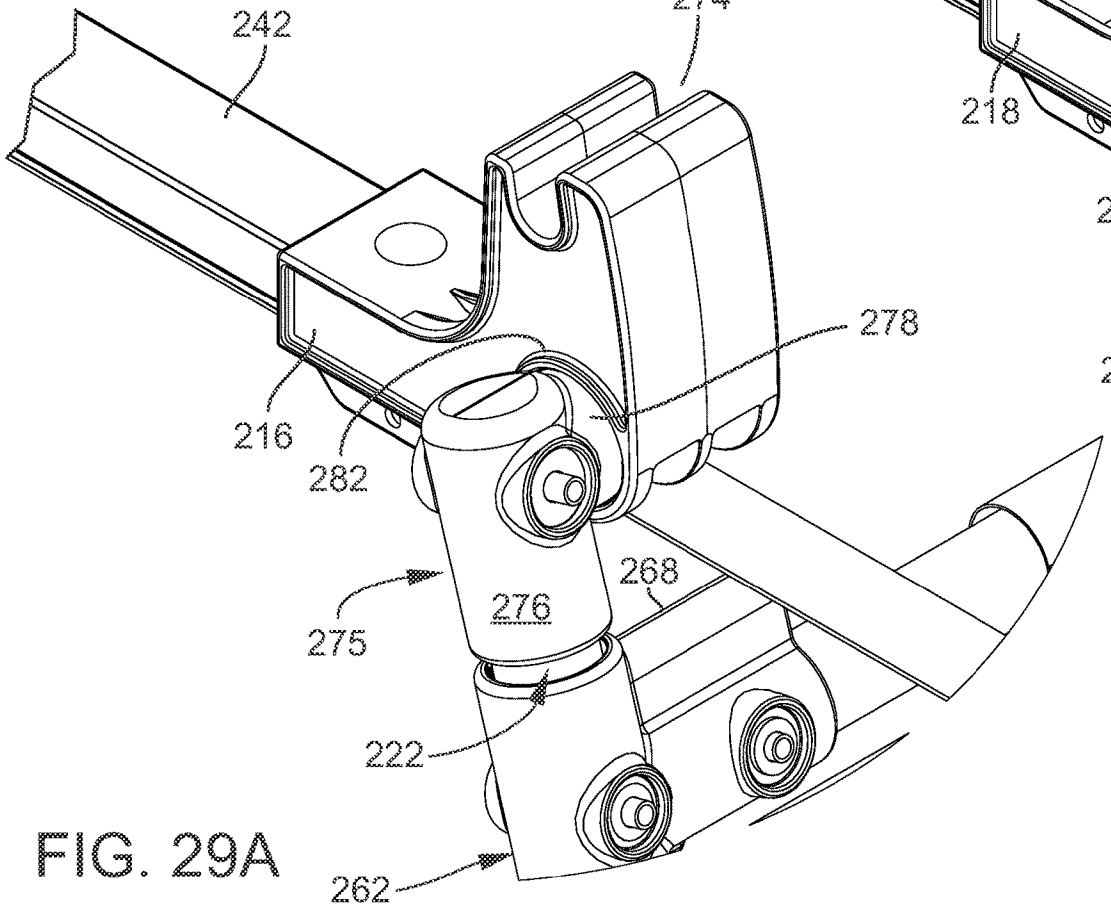
FIG. 29A shows a detail perspective view of the left end portion of the bottom rail assembly of FIG. 25 having been displaced from the left bottom rail receptor of FIG. 25.

FIG. 26A and FIG. 26B show enlarged views of the left and right bases 216, 218, respectively, and the lower frame member 220 extending therebetween. Lower frame member 220 includes a left tube 258, a right tube 260, and a seating and sliding assembly 262. The seating and sliding assembly 262 makes up the outer ends of the left and right tubes 258, 260. The seating and sliding assembly 262 includes a tube receptor 264, a cylinder 266, and a single arm 268. Tube receptor 264 is rigidly engaged to cylinder 266 and extends inwardly from cylinder 266 to engage the outer end of its respective left or right tube 258, 260. Tube receptor 264 is tubular and is a female receptor for the male outer end of left or right tube 258, 260. A pin 270, such as a rivet, engages the tube receptor 264 to its respective left or right tube 258, 260. A brace 272 is engaged at the junction between the outer end of the tube receptor 264 and the top inner end of the cylinder 266. The single arm 268 depends from and may be integral with tube receptor 264. Tube receptor 264 and single arm 268 form a T-shape with cylinder 266. An outer end of single arm 268 is engaged to and may be integral with cylinder 266. Single arm 268 has an outer end that engages cylinder 266. Single arm 268 has an inner end that defines a vertical plane with the inner open end of tube receptor 264. Single arm 268 has a section that is formed in the shape of an inverted U such that single arm 268 has a curved bottom end that is seated in its respective base 216, 218. The height of single arm 268 has a distance less than a distance between the top end of cylinder 266 and the bottom edge of sheeting portion 238 such that the seating and sliding assembly 262 may be slid up the guard rail frame ends 222, 224 and out of engagement with bases 216, 218 prior to the cylinders 266 making contact with the bottom edge of sheeting portion 238. The thickness of the single arm 268 at its upper portion is less than the thickness or diameter of the tube receptor 264. Single arm 268 can be referred to as a seat engaging piece, where each of the left and right bases 216, 218 includes a U-shaped seat 274 that is tailored to fit the length, height, and thickness of the single arm 268. The length of the single arm 268 extends in the axial direction of bottom rail 220 and the height of single arm 268 extends in the axial direction of its respective guard rail frame end 222, 224.

Spaced from seating and sliding assembly 262 is a pivot assembly 275 that engages a bottom end of its respective guard rail frame member 222, 224. Pivot assembly 275 includes a tube receptor 276 rigidly engaged at a right angle to a pivot 278 or pivot body 278 or pivot pin 278. Tube receptor 276 is cylindrical and engages the bottom end of its respective guard rail frame member 222, 224 with a pin 280 such as a rivet. Pin 280 engages diametrically opposed pin holes 281. Tube receptor 276 includes a closed end 277. Pivot body 278 is cylindrical and engages a pivot receptor 282 formed in each of the left and right bases 216, 218. Guard rail frame 212 swings on the pivot 278 when the single arm 268 is disengaged from the seat 274. Pivot 278 extends inwardly from the lower end portion of its respective guard rail frame end 222, 224. The axis of pivot 278 and the axis of bottom rail 220 are in a common plane with the guard rail frame 212.

Figure 34:
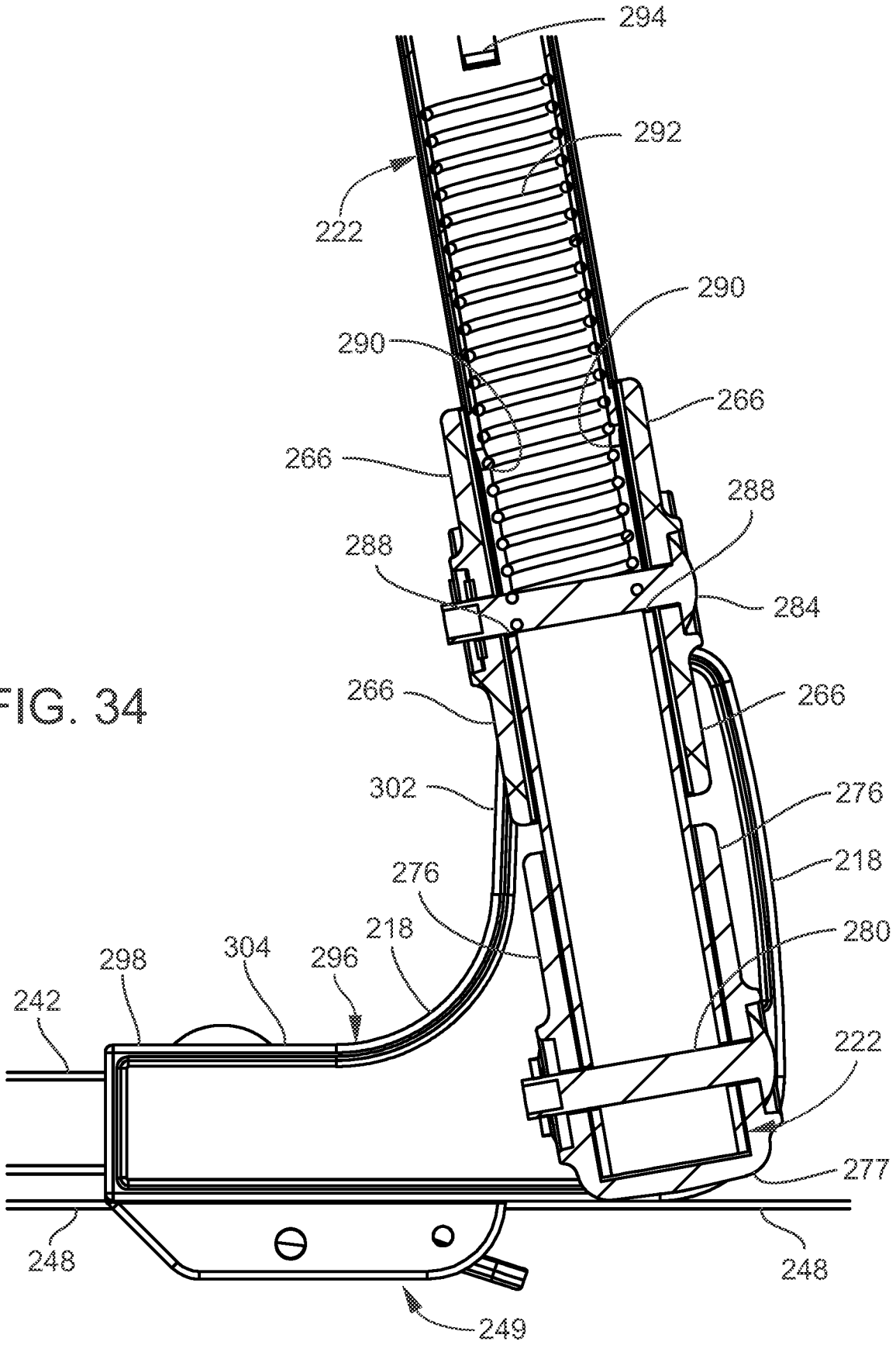
FIG. 34 is a detail view of a portion of FIG. 33.
Figure 35:
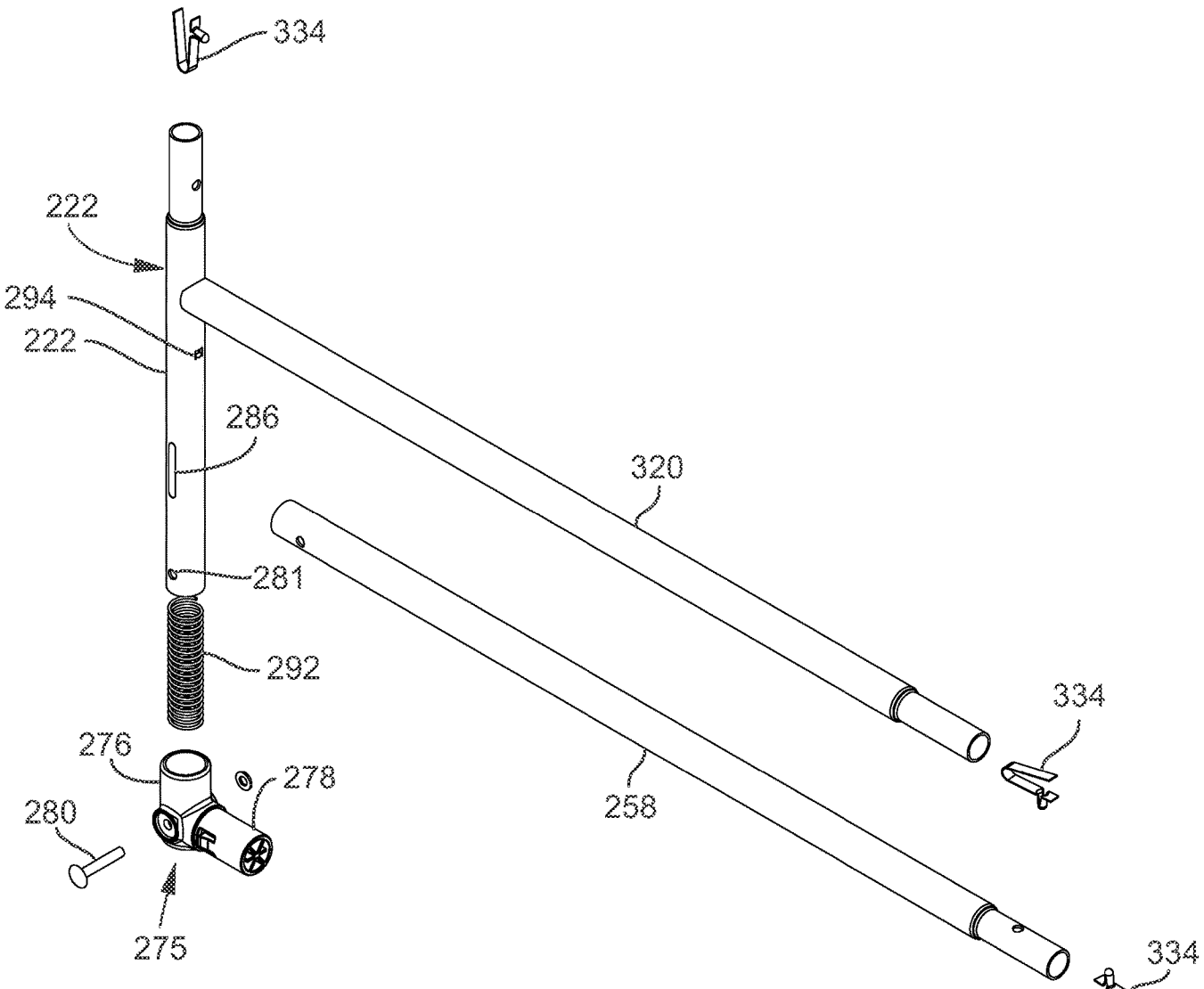
FIG. 35 is identical to the view of FIG. 32 except that a portion of the bottom rail assembly has been removed to show a vertical slot that is formed in the left end frame portion of the guard rail, where the vertical slot receives a through pin and permits engagement of the bottom rail assembly to the left end frame portion of the guard rail while allowing vertical sliding of the bottom rail assembly on the left end frame portion of the guard rail.

Seating and sliding assembly 262 slides to and away from pivot assembly 275 by a pin 284 riding vertically in a pair of slots 286. Pin 284 is rigidly fixed to cylinder 266 and extends front to back diametrically through its respective guard rail frame end 222, 224. Each of the guard rail frame ends 222, 224 includes a pair of the slots 284 that are formed therein diametrically opposite of each other. Each of the slots 286 includes a lower end 288 and an upper end 290, as shown in FIG. 34. The pin 284 and thus the seating and sliding assembly 262 are biased toward seats 274 in the left and right bases 216, 218 and toward the bottom end portions of the guard rail frame ends 222, 224 by a coil spring 292 disposed in the tubular guard rail frame ends 222, 224. Coil spring 292 is pinched between inwardly punched tabs 294 and the pin 284. Each of the guard rail frame ends 222, 224 may include a pair of diametrically opposed inwardly punched tabs 294.

Figure 31:
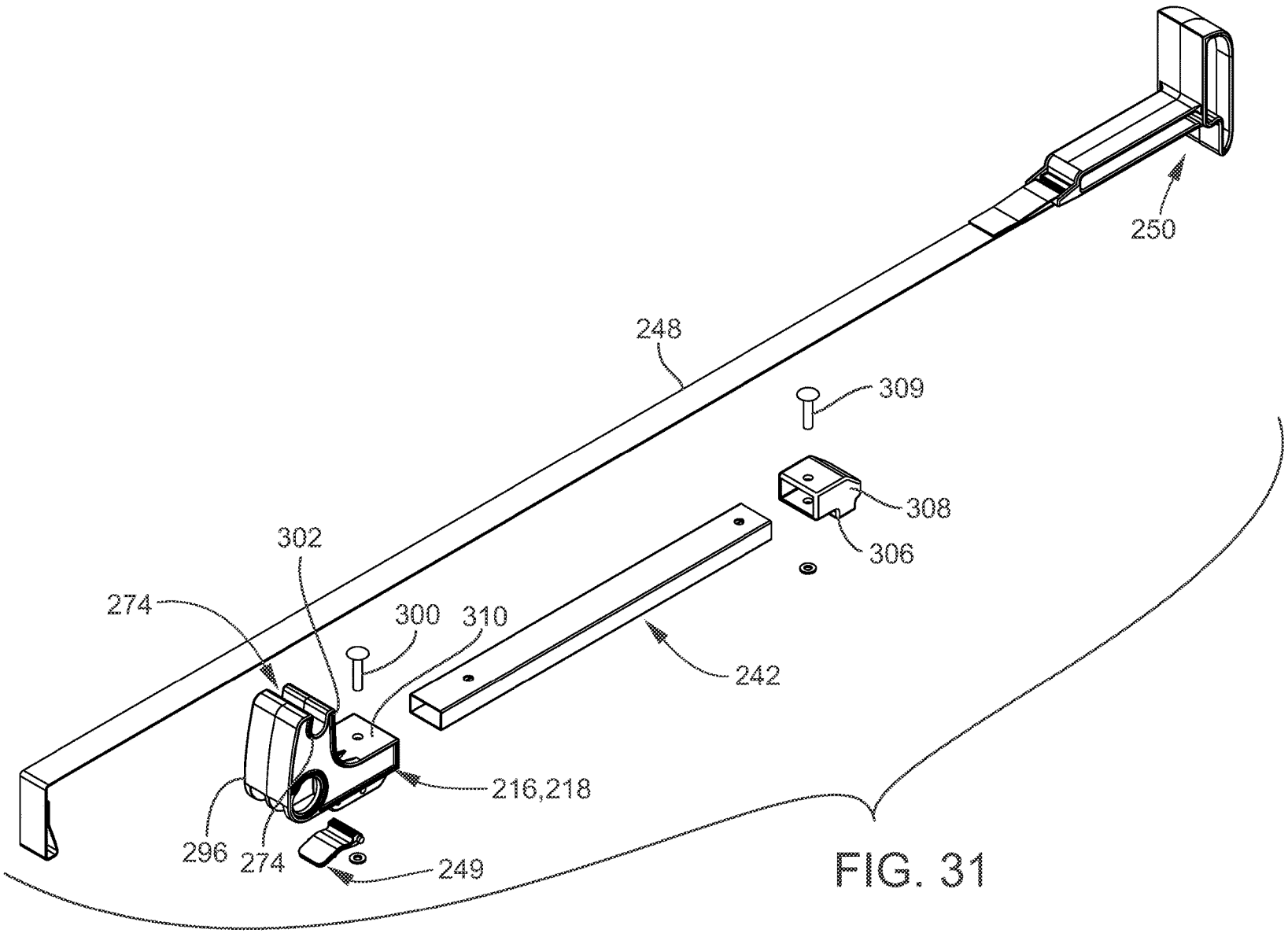
FIG. 31 is a detail perspective exploded view of a bottom rail receptor, leg frame portion, strap, and counter member of the bed rail of FIG. 22.
Figure 32:
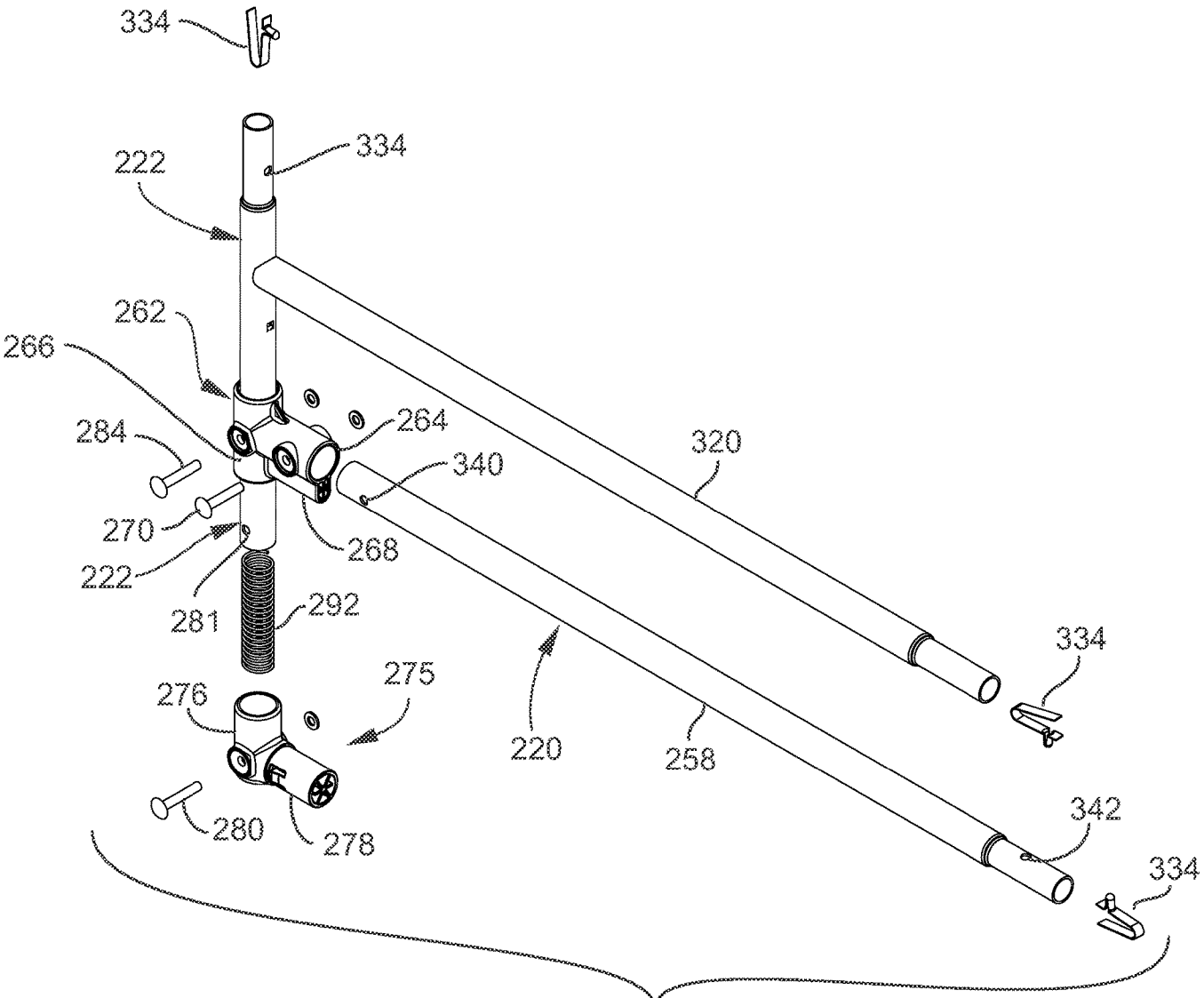
FIG. 32 is a detail perspective exploded view of portions of the bottom rail assembly and guard rail of FIG. 22.
Figure 33:
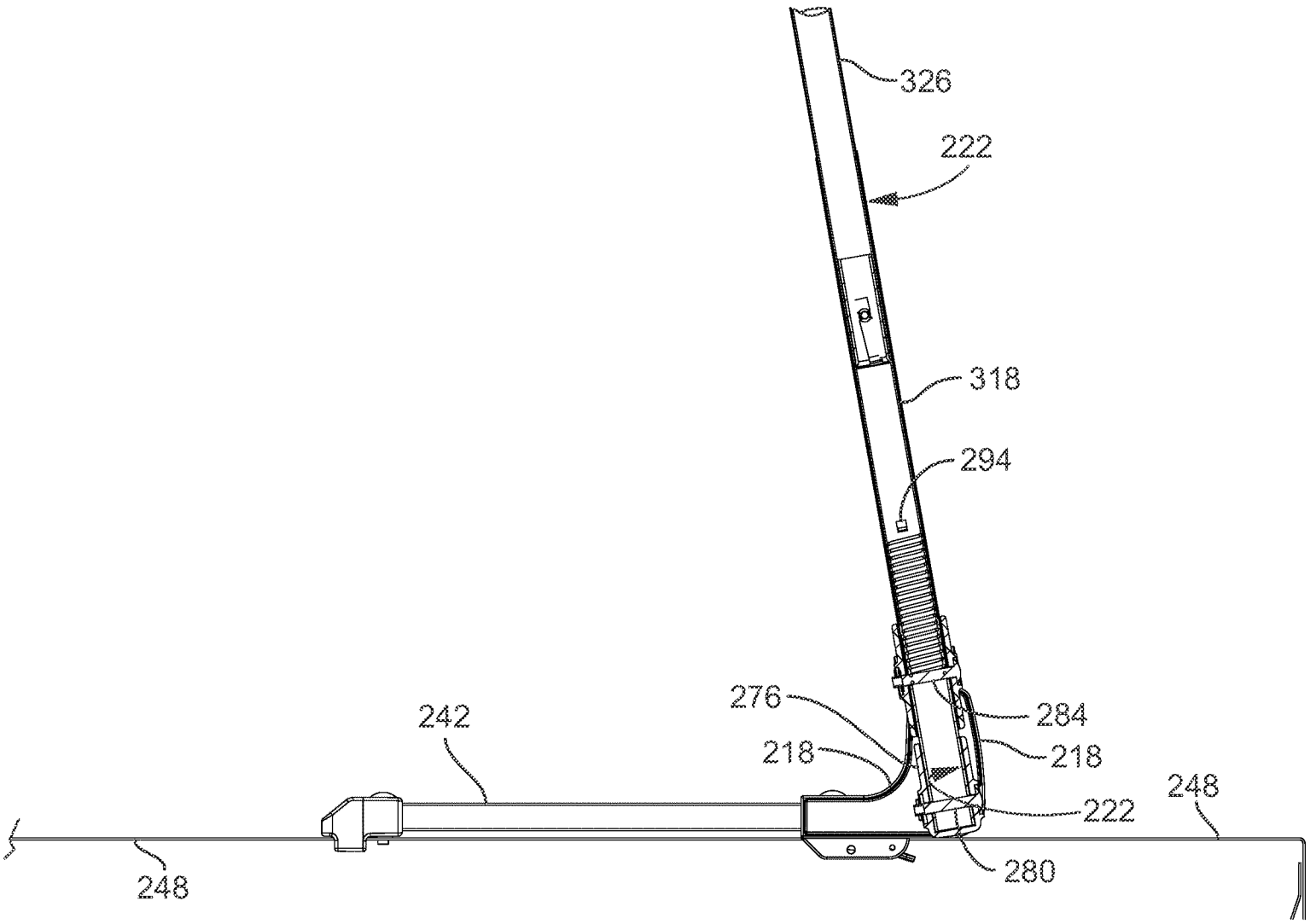
FIG. 33 is a section view of the left end frame member of the guard frame including the bottom rail assembly of FIG. 22.

As shown in FIGS. 31, 33, and 34 each of the left and right bases 216, 218 includes a body 296 that is V-shaped. At the junction of the V-shape of the body 296 is the pivot receptor 282 that receives pivot 278. Pivot receptor 282 is a through hole that opens at each of the sides of the body 296 such that body 296 may be used for each of the left and right bases 216, 218. Along a first branch of the V-shape is a leg receptor 298 for the proximal end 244 of leg 242. A pin 300 fixes the leg 242 to the body 296. At the end of the other branch of the V-shaped body is disposed the seat 274 for seating the single arm 268 of the seating and sliding assembly 262. Seat 274 extends from one side of the base body 296 to the other side of the base body 296. Seat 274 is open at each of the sides of the base body 296. Seat 274 is open at the top of the base body 296. Catch mechanism 249 is engaged at a bottom of the base body 296. An inner and obliquely extending face 302 of the base body 296 acts as a counter member that engages the near side of the mattress opposite to that which the upper extension 56 of counter member 50 engages. An inner and horizontally extending face 304 engages the undersurface of the mattress, which serves as a weight for holding base body 296 and leg 242 in place between the mattress and mattress support, such as a box spring. Base body 296 is further held in place by strap 248 extending underneath leg 242, through slot 306 of leg end piece 308, to counter member 250, which engages the far side of the mattress and mattress support. Strap 248 is engaged to base body 296 by catch mechanism 249. Leg end piece 308 is engaged to leg 242 via a pin 309.

Left and right bases 216, 218 have outer ends or sides and inner ends or sides. Pivots 278 enter the pivot receptors 282 through the outer ends of the left and right bases 216, 218. Cylinder 266 of the seating and sliding assembly 262 closes off the outer open end of its respective seat 274 of the base body 296 when the single arm 268 is engaged in seat 274. The guard rail frame ends 222, 224 confront or are adjacent to the outer sides of the left and right bases 216, 218.

U-shaped seat 274 of the body 296 includes opposing planar walls that extend obliquely relative to the vertical and relative to the flat horizontal face 304 of body 296. This obliqueness provides an upward and inward direction to the guard rail 212 when the seating and sliding assembly 262 is engaged to the left and right seats 216, 218.

Figure 30:
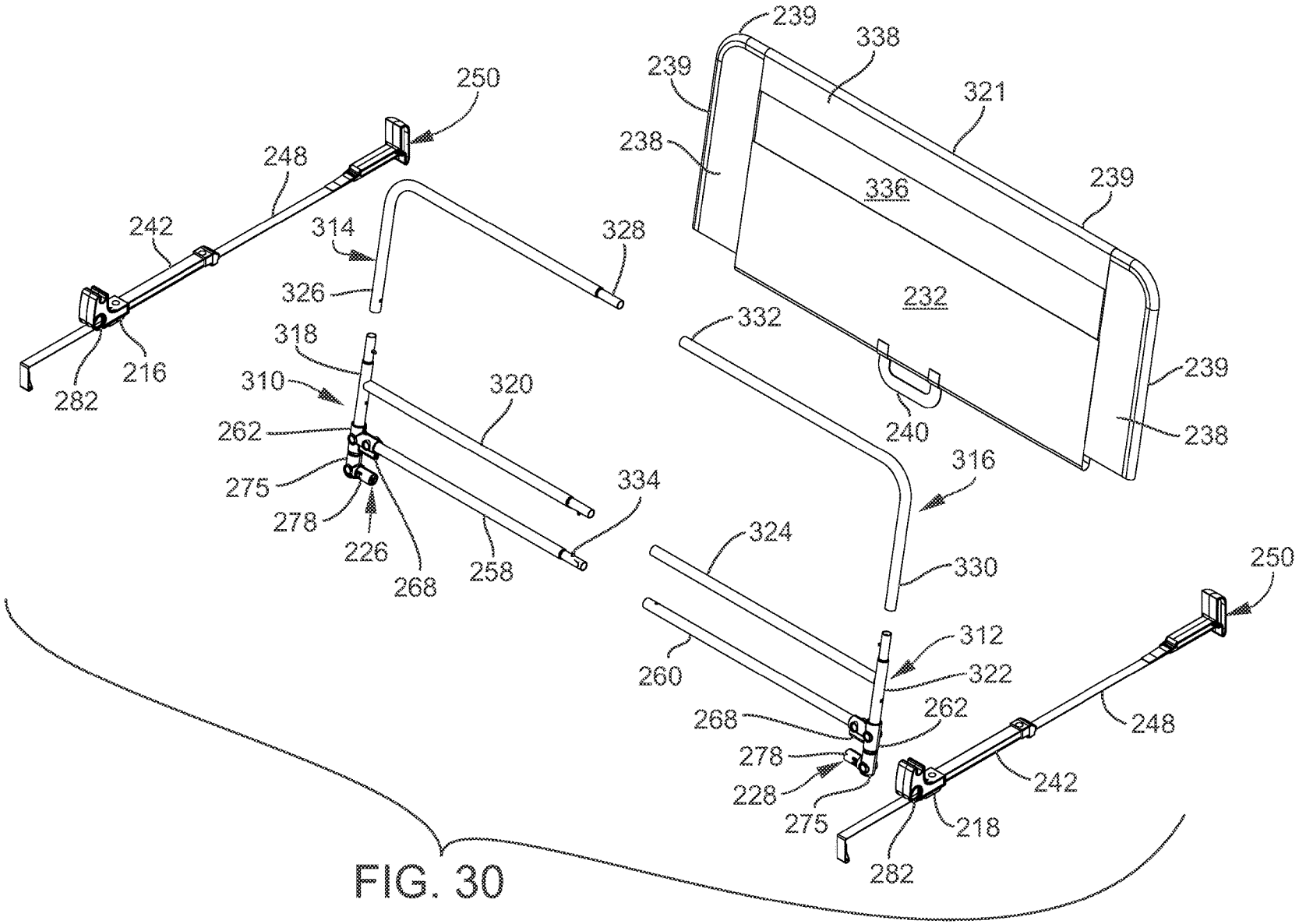
FIG. 30 is a perspective exploded view of the bed rail of FIG. 22.

As shown in FIG. 30, guard rail frame 212 includes four units: a first unit 310, a second unit 312, a third unit 314, and a fourth unit 316.

First unit 310 includes a tubular end frame portion 318 that is a portion of end frame member 222 and engages cylinder 266 and tube receptor 276 and includes slot 286. Tubular end frame portion 318 includes a distal male connector end. First unit 310 further includes tubular horizontal members 258, 322 that extend inwardly from tubular end frame portion 318. Tubular horizontal member 258 is a portion of tubular bottom rail 220 and includes a male connector end on its inner end. Tubular horizontal member 320 is disposed at a greater elevation than tubular horizontal member 258 and includes a male connector end on its inner end. Tubular horizontal members 258 and 320 run parallel to each other and are of the same length. Tubular horizontal member 320 may be disposed so as to be adjacent to the upper edge of the mattress such that tubular horizontal member 320 is disposed in or adjacent to a plane of the sleeping surface of the mattress.

Second unit 312 includes a tubular end frame portion 322 that is a portion of end frame member 224 and engages cylinder 266 and tube receptor 276 and includes slot 286. Tubular end frame portion 318 includes a distal male connector end. Second unit 312 further includes tubular horizontal members 260, 324 that extend inwardly from tubular end frame portion 322. Tubular horizontal member 260 is a portion of tubular bottom rail 220 and includes a female connector end, or open end, on its inner end that engages the male connector end of tube portion 258. Tubular horizontal member 324 is disposed at a greater elevation than tubular horizontal member 260 and includes a female connector end, or open end, on its inner end that engages the male connector end of tube portion 320. Tubular horizontal members 260 and 324 run parallel to each other and are of the same length. Tubular horizontal member 324 may be disposed so as to be adjacent to the upper edge of the mattress such that tubular horizontal member 324 is disposed in or adjacent to a plane of the sleeping surface of the mattress.

Third unit 314 is a tubular L-shaped member or portion with a female connector end 326 that engages the male connector end of tube portion 318 and a male connector end 328.

Fourth unit 316 is a tubular L-shaped member or portion with a female connector end 330 that engages the male connector end of tube portion 322 and a female connector end 332 that engages male end 328 of third unit 314.

The first unit 310 engages the second and third units 312, 314. The second unit 312 engages the first and third units 310, 316. The third unit 314 engages the first and fourth units 310, 316. The fourth unit 316 engages the second and third units 312, 314.

A quick connect button assembly 334 may be engaged between the inner male and female ends of tube portions 258, 260. A quick connect button assembly 334 may be engaged between the inner male and female ends of tube portions 320, 324. A quick connect button assembly 334 may be engaged between the ends of tube portions 318 and 314. A quick connect button assembly 334 may be engaged between the ends of tube portions 322 and 316. An engagement between male connector end 328 of the third unit 314 and the female connector end 332 of the fourth unit 316 may or may not have a quick connect button assembly 334. Button assembly 334 is a metal spring with a button that is biased outwardly and extends through aligned openings in the male and female ends of tube portions such that the tube portions can be readily disengaged and engaged from each other by, respectively, pressing such button in to permit the tube portions to slide relative to one another or permitting the button to pop out to fix the tube portions against such sliding.

FIGS. 21A, 22, 26A, 27A show the guard rail frame 212 engaged with the left and right bases 216, 218. FIGS. 21B, 23, 27A, 27B show the guard rail frame 212 having just been lifted off the left and right bases 216, 218 with a compression of coil spring 292 and without operation of a latch or button mechanism or any other mechanics. FIGS. 21C, 24, 28A, 28B show the guard rail frame 212 being pivoted downwardly from the position shown in FIGS. 21B, 23, 27A, 27B about pivot 278. FIGS. 21D, 25, 29A, 29B show the guard rail frame 212 having been pivoted about pivot 278 further downwardly from the position shown in FIGS. 21C, 24, 28A, 28B. From the position shown in FIGS. 21D, 25, 29A, 29B, the guard rail frame 212 may be pivoted upwardly to the position shown in FIGS. 21C, 24, 28A, 28B and then may be pivoted further upwardly through a vertical plane to the position shown in FIGS. 21B, 23, 27A, 27B, which position is slightly oblique relative to the vertical, whereupon the bottom rail 220 is set obliquely downwardly such that the single arms 268 of the seating and sliding assemblies 262 engage the seats 274 of the right and left bases 216, 218.

From the position shown in FIGS. 21A, 22, 26A, 26B to the position shown in FIGS. 21B, 23, 27A, 27B, the coil spring 292 is compressed. From the position shown in FIGS. 21B, 23, 27A, 27B and to or toward the position shown in FIGS. 21C, 24, 28A, 28B, the coil spring 292 may extend the bottom rail 220. In reverse, from the position shown in FIGS. 21C, 24, 28A, 28B to the position shown in FIGS. 21B, 23, 27A, 27B, the handle 240 may be operated or drawn toward a top of the guard rail frame 212 so as to compress the coil spring 292. Alternatively, the coil spring 292 may remain at its extended position where pin 284 abuts slot ends 288, whereupon when the U-shaped or curved bottom ends of the single arms 268 engage the curved front top ends of the bases 216, 218, the coil spring 292 automatically retracts and, with a further urging or pivoting of the guard rail frame 212 rearwardly, the single arms 268 automatically snap into their respective seats 274 by an automatic extension of coil springs 292. It can be appreciated that there is no automatic disengagement of the single arms 268 from their respective seats 274.

Left and right bases 216, 218 are preferably formed of a plastic, but can be metal if desired. Cylinder 264 and cylinder 266 are preferably formed of plastic, but can be metal if desired. Tube receptor 276 and pivot 278 are preferably formed of plastic, but can be metal if desired. Leg 242 is preferably formed of metal, but can be plastic if desired. Guard rail frame members 220, 222, 224 and 230 are preferably formed of a metal. Tube intermediate frame members 320, 324 are preferably formed of a metal. Sheeting 231 is formed of a flexible textile or flexible fabric. A portion of sheeting 231, such as a portion 336, may be formed of a mesh. Sheeting portion 338 may be formed of the same flexible textile as sheeting portion 232. Mesh portion 336 extends to and between sheeting portions 238. Sheeting portion 338 extends between sheeting portions 238.

The four units 310, 312, 314, 316 may if desired be pre-assembled at the factory. Sheeting 231 if desired may be pre-installed on the guard rail 212 at the factory. Sheeting 231 may have elongate zippered openings at strategic locations such that sheeting 231 can be removable from the guard rail 212 for cleaning.

Bottom rail frame member 220 includes a pair of diametrically opposed pin holes 340 that receive and engage pin 270 of the seating and sliding assembly 262. Bottom rail frame member 220 includes a button hole 342 that receives the button of one of the quick connects 334. Tube portion 320 also includes a button hole for receiving the button of one of the quick connects 334. Such button is disposed at an underside location opposite to where button hole 342 would be. Each of the end frame members 222, 224 includes a button hole 344 that receives and engages the button of one of the quick connects 334. Each of tube portions 260, 324 includes button holes in their female outer ends that align with the button holes of tube portions 258, 320. The lower female ends of tube portions 326, 330 also include button holes for quick connects 334.

In operation, the left side base 216 is brought to the inside of the left seating and sliding assembly 262 and the left pivot 278 is pushed into the left pivot receptor 282 from the outside of the left side base 216. Then the right side base 218 is brought to the inside of the right seating and sliding assembly 262 and the right pivot 278 is pushed into the right pivot receptor 282 from the outside of the right side base 218. Pivots 278 may not be removable from pivot receptors 282 once inserted therein. The integrity of one or more of the pivot 278 and pivot receptor 282 may be destroyed if removal of the pivot 278 is attempted. Then the legs 242 and straps 248 are disposed between a mattress and mattress support and the counter members 250 are engaged on the far side of the mattress. Then, using the catch mechanisms 249, the straps 248 are tightened until the mattress is squeezed between the counter members 250 and the faces 302 of the left and right bases 216, 218. This process of engaging the bed rail 210 to the mattress may be done with the guard frame 212 in any position. When the guard frame 212 is in the position shown in FIGS. 21A, 22, 26A, 26B, the guard frame 212 is in an oblique position relative to the vertical and relative to the side of the mattress. To swing down the bed rail 210, the handle 240 is grasped and lifted with one hand, whereupon the bottom rail 220 is lifted and the single arms 268 are lifted out of their respective seats 274. Then the handle 240 may be drawn toward oneself to place the cylinders 264 forwardly of the left and right bases 216, 218, whereupon the coil spring 292 automatically extends when manual effort is released so as to locate the cylinders 264 forwardly of the bases 216, 218 and downwardly so as to minimize a return of the single arms 268 to the seats 274. As the guard rail 212 is pivoted forwardly and downwardly, the guard rail 212 may pivot through the position shown in FIGS. 21C, 24, 28A, 28B and then may pivot further downwardly to and through the position shown in FIGS. 21D, 25, 29A, 20B. Then, to again place the guard rail 212 against the side of the mattress, the handle 240 may be grasped and lifted to raise the guard rail 212, or the guard rail 212 may be raised by manually engaging the guard rail 212 at other locations. As the guard rail 212 pivotally approaches a vertical plane, the bottom rail 220 may be lifted via the handle 240 or other portion of the guard rail 212 to compress the coil spring 292 and slide cylinders 266 up the end frame members 222, 224 until the single arms 268 clear the tops of the left and right bases 16, 218, whereupon the bottom rail 220 may be lowered so as to set the single arms 268 in their respective seats 274. Alternatively, the bottom rail 220 need not be lifted. The U-shaped bottom portion of the single arms 268 may abut and slide against the curved top portions of the left and right bases 216, 218, an action that itself automatically pushes the single arms 268 and cylinders 264, 266 upwardly until the single arms 268 slide sufficiently rearwardly to snap downwardly into their respective seats 274, whereupon the bed rail 210 is in its operating oblique position at the side of the mattress.

Side to side movement of the single arms 268 in their respective seats 274 is minimized by cylinders 266 that confront the outside of the bases 216, 218 and thus confront the open outer end of each of the respective seats 274.

Lifting portions of the bed rail 210 other than the bottom rail frame member 220, handle 240, and the seating and sliding assembly 262, does not result in a disengagement of single arms 268 from seats 274.

It can be noted that, whereas frame member 20 defines a plane with its respective leg 42 and whereas frame member 22 defines a plane with its respective leg 42, it can be noted that frame member 222 is offset from and outside of a plane defined by its leg 242 and the left side base 216 and that frame member 224 is offset from and outside of a plane defined by its leg 242 and the right side base 218.

Left and right bases 216, 218 may be referred to as left and right bottom rail receptors.

Single arms 268 may also be referred to as seat engaging arms, pieces, or portions.

The length of slots 286 is slightly greater than the depth of U-shaped seats 274, or is slightly greater than the distance the cylinders 266 axially slide on guard rail end frame members 222, 224 to disengage the seating and sliding assembly 262 from the left and right bases 216, 218 such that the guard rail frame 212 can start to pivot forwardly freely.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A bottom rail controlled bed rail comprising:

a) a left side base and a right side base, the left side base having a left seat, the right side base having a right seat;

b) a frame that includes a first frame portion;

c) the first frame portion including a left end frame member, a right end frame member, an upper frame member, and a lower frame member, the upper frame member extending between the left and right end frame members, the lower frame member extending between the left and right end frame members;

d) the first frame portion being pivotally engaged to the left side base at a left pivot location and the first frame portion being pivotally engaged to the right side base at a right pivot location such that the first frame portion is swingable between up and down positions;

e) the lower frame member being seatable in the left seat of the left side base, the lower frame member being seatable in the right seat of the right side base, the first frame portion being fixed relative to the second frame portion when the lower frame member is seated in the left and right seats, the first frame portion being swingable relative to the left side base and right side base when the first frame portion is out of the left and right seats; and f) the lower frame member being slideably engaged on each of the left and right end frame members such that the lower frame member is slideable relative to the upper frame member and such that the lower frame member is slideable out of the left and right seats whereupon the first frame portion is swingable.

2. The bottom rail controlled bed rail of claim 1, wherein the lower frame member is spring biased toward a seated position in the left and right seats of the left and right side bases, respectively, where the first frame portion is fixed relative to the second frame portion.

3. The bottom rail controlled bed rail of claim 1, wherein the lower frame member includes a left end cylindrical portion that slides axially on the left end frame member, and wherein the lower frame member includes a right end cylindrical portion that slides axially on the right end frame member.

4. The bottom rail controlled bed rail of claim 1, wherein the left pivot location on the left side base is spaced from the left seat in the left side base and wherein the right pivot location on the right side base is spaced from the right seat in the right side base.

5. The bottom rail controlled bed rail of claim 1, wherein the left end frame member is pivotally engaged to the left side base and wherein the right end frame member is pivotally engaged to the right side base.

6. The bottom rail controlled bed rail of claim 1, and further comprising a handle engaged to the lower frame member such that a user may readily grasp the handle to thereby lift the lower frame member out of the left and right seats with one hand.

7. The bottom rail controlled bed rail of claim 1, the lower frame member including left and right ends, and further comprising a handle engaged to the lower frame member intermediate of the left and right ends of the lower frame member such that a user may readily grasp the handle to thereby lift the lower frame member out of the left and right seats with one hand.

8. The bottom rail controlled bed rail of claim 1, wherein the lower frame member comprises:

a) a left lower tube portion, a right lower tube portion, and a handle intermediate outer ends of the left and right lower tube portions;

b) a left cylindrical portion that slides axially on the left end frame member and a right cylindrical portion that slides axially on the right end frame member;

c) a left tubular receptor extending inwardly from the left cylindrical portion for engagement of the left lower tube portion and a right tubular receptor extending inwardly from the right cylindrical portion for engagement of the right lower tube portion; and d) a left arm extending from the left cylindrical portion for engaging the left seat of the left side base and a right arm extending from the right cylindrical portion for engaging the right seat of the right side base.

9. The bottom rail controlled bed rail of claim 1, wherein the lower frame member is a horizontally extending frame member, and wherein the lower frame member is a bottom-most horizontally extending frame member of the first frame portion.

10. A bottom rail controlled bed rail comprising:

a) a left side base and a right side base;

b) a frame that includes a first frame portion and a second frame portion;

c) the first frame portion including a left end frame member, a right end frame member, an upper frame member, and a lower frame member, the upper frame member extending between the left end frame member and the right end frame member, the lower frame member extending between the left end frame member and the right end frame member;

d) the first frame portion being pivotally engaged to the left side base at a first location, the lower frame member being releasably engaged to the left side base at a second location, the first and second locations being spaced from each other;

e) the first frame portion being pivotally engaged to the right side base at a third location, the lower frame member being releasably engaged to the right side base at a fourth location, the third and fourth locations being spaced from each other;

f) the first location on the left side base and the third location on the right side base permitting the first frame portion to be swingable between up and down positions;

g) the second location on the left side base and the fourth location on the right side base permitting the first frame portion to be fixed relative to the left side base and right side base when the lower frame member is engaged at the second and fourth locations;

h) the second location on the left side base and the fourth location on the right side base permitting the first frame portion to be swingable relative to the left side base and right side base when the lower frame member is disengaged from the second and fourth locations;

i) the lower frame member being slideably engaged on each of the left end frame member and right end frame member such that the lower frame member is slideable relative to the upper frame member and such that the lower frame member may be slid on the left frame member and the right end frame member away from the second and fourth locations such that the first frame portion may swing relative to the second frame portion.

11. The bottom rail controlled bed rail of claim 10, wherein the second location comprises a left seat in the left side base, wherein the fourth location comprises a right seat in the right side base.

12. The bottom rail controlled bed rail of claim 11, wherein the right seat includes a U-shape and wherein the left seat includes a U-shape.

* * * * *